US009141082B1

(12) United States Patent
Kuge et al.

(10) Patent No.: US 9,141,082 B1
(45) Date of Patent: Sep. 22, 2015

(54) PROCESS CARTRIDGE AND IMAGE FORMING APPARATUS USING THE PROCESS CARTRIDGE

(71) Applicant: FUJI XEROX CO., LTD., Minato-ku, Tokyo (JP)

(72) Inventors: Hideki Kuge, Kanagawa (JP); Toyohiko Awano, Kanagawa (JP); Keisuke Morita, Kanagawa (JP); Yoshiyuki Takashima, Kanagawa (JP); Kohyu Shigemori, Kanagawa (JP); Masatoshi Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/487,204

(22) Filed: Sep. 16, 2014

(30) Foreign Application Priority Data

Mar. 27, 2014 (JP) ..... 2014-067225

(51) Int. Cl.
*G03G 21/18* (2006.01)

(52) U.S. Cl.
CPC ..... *G03G 21/1803* (2013.01)

(58) Field of Classification Search
CPC combination set(s) only.
See application file for complete search history.

(56) References Cited

U.S. PATENT DOCUMENTS 6,366,749 B1 4/2002 Koumoto
2013/0322918 A1* 12/2013 Igarashi et al. ..... 399/110

FOREIGN PATENT DOCUMENTS

JP 11-84986 A 3/1999
JP 2001-222205 A 8/2001
JP 2006-91582 A 4/2006

* cited by examiner

*Primary Examiner* — Clayton E LaBalle
*Assistant Examiner* — Jas Sanghera
(74) *Attorney, Agent, or Firm* — Sughrue Mion, PLLC

(57) ABSTRACT

A process cartridge includes an image holding body assembly that includes an image holding body, a developing assembly that includes a developer holding body, an urging member, a contacting and separating mechanism, and a gap forming mechanism. The image holding body assembly is inserted into and pulled from an assembly receiving portion. The urging member urges the developing assembly so that the developer holding body is pressed against the image holding body. The contacting and separating mechanism is disposed on the front side and operated to separate the image holding body assembly and the developing assembly from each other against an urging force. The gap forming mechanism forms a gap between the image holding body and the developer holding body on the rear side against the urging force. The size of the gap is larger than that existing before the image holding body assembly is pulled.

5 Claims, 31 Drawing Sheets

FIG. 31

| EXAMPLE | FIRST RIB | SECOND RIB | MAXIMUM STRESS (MPa) | MAXIMUM DEFORMATION (mm) | EVALUATION |
|---|---|---|---|---|---|
| FIRST EXAMPLE | PROVIDED | PROVIDED | 6.7 | 2.4 | GOOD |
| SECOND EXAMPLE | PROVIDED | PROVIDED | 5.9 | 2.8 | GOOD |
| COMPARATIVE EXAMPLE | NOT PROVIDED | NOT PROVIDED | 14.6 | 12.9 | MEDIOCRE |

PROCESS CARTRIDGE AND IMAGE FORMING APPARATUS USING THE PROCESS CARTRIDGE

CROSS-REFERENCE TO RELATED APPLICATIONS

This application is based on and claims priority under 35 USC 119 from Japanese Patent Application No. 2014-067225 filed Mar. 27, 2014.

BACKGROUND

Technical Field

The present invention relates to a process cartridge and an image forming apparatus using the process cartridge.

SUMMARY

A process cartridge having a front side and a rear side according to an aspect of the present invention includes an image holding body assembly, a developing assembly, an urging member, a contacting and separating mechanism, and a gap forming mechanism. The image holding body assembly is inserted into and pulled from a predetermined assembly receiving portion in an insertion and pulling direction, which extends along a line that connects the front side and the rear side to each other. The image holding body assembly includes an image holding body which holds a latent image and which has longitudinal ends. The developing assembly includes a developer holding body holding a developer and a guide portion which extends in the insertion and pulling direction. The urging member urges the developing assembly so that the developer holding body of the developing assembly is pressed against both the longitudinal ends of the image holding body of the image holding body assembly. The contacting and separating mechanism is disposed on the front side in the insertion and pulling direction in the image holding body assembly. The contacting and separating mechanism is operated in a predetermined direction so as to cause the image holding body assembly and the developing assembly to be moved in a direction in which the image holding body assembly and the developing assembly are separated from each other against an urging force applied by the urging member. The gap forming mechanism forms a gap between the image holding body and the developer holding body on the rear side against the urging force of the urging member by bringing, when the image holding body assembly is pulled in the insertion and pulling direction while the developing assembly is separated from the image holding body assembly by the contacting and separating mechanism, part of the image holding body assembly on the rear side in the insertion and pulling direction into contact with the guide portion. The gap forming mechanism forms the gap having a size larger than a size of a gap existing before the image holding body assembly is pulled.

BRIEF DESCRIPTION OF THE DRAWINGS

Exemplary embodiments of the present invention will be described in detail based on the following figures, wherein:

FIG. 31 illustrates an example of evaluation of stress and the amount of deformation of the developing assemblies of a first example, a second example, and a first comparative example.

DETAILED DESCRIPTION

Outline of Exemplary Embodiments

Figure 1A:
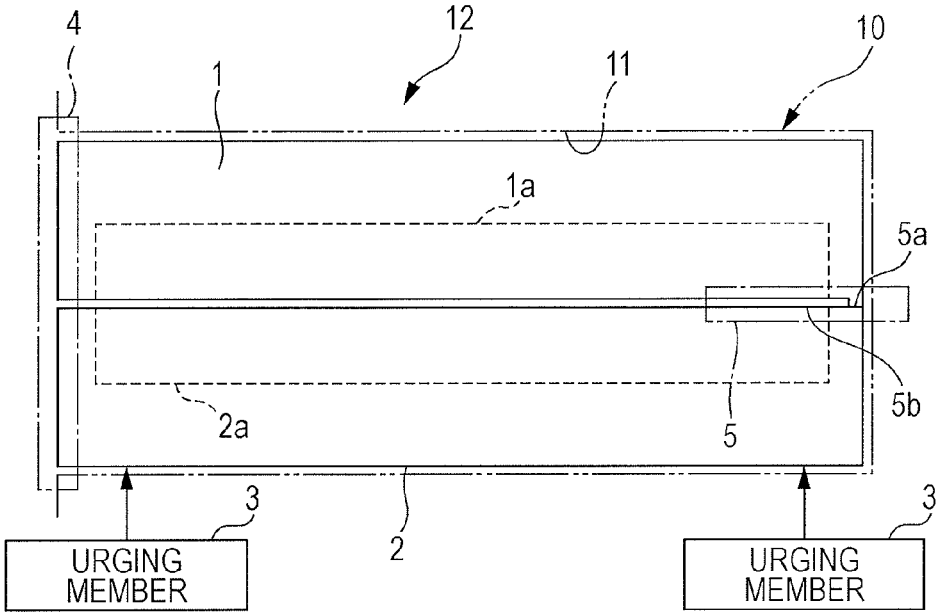
FIG. 1A illustrates an outline of an exemplary embodiment, to which the present invention is applied, of an image forming apparatus that includes a process cartridge.

FIG. 1A illustrates an outline of an exemplary embodiment of an image forming apparatus to which the present invention is applied.

Referring to FIG. 1A, the image forming apparatus includes an apparatus housing 10 and a process cartridge 12. The apparatus housing 10 includes a predetermined assembly receiving portion 11. The process cartridge 12 is detachably attached to the assembly receiving portion 11 of the apparatus housing 10.

Figure 1B:
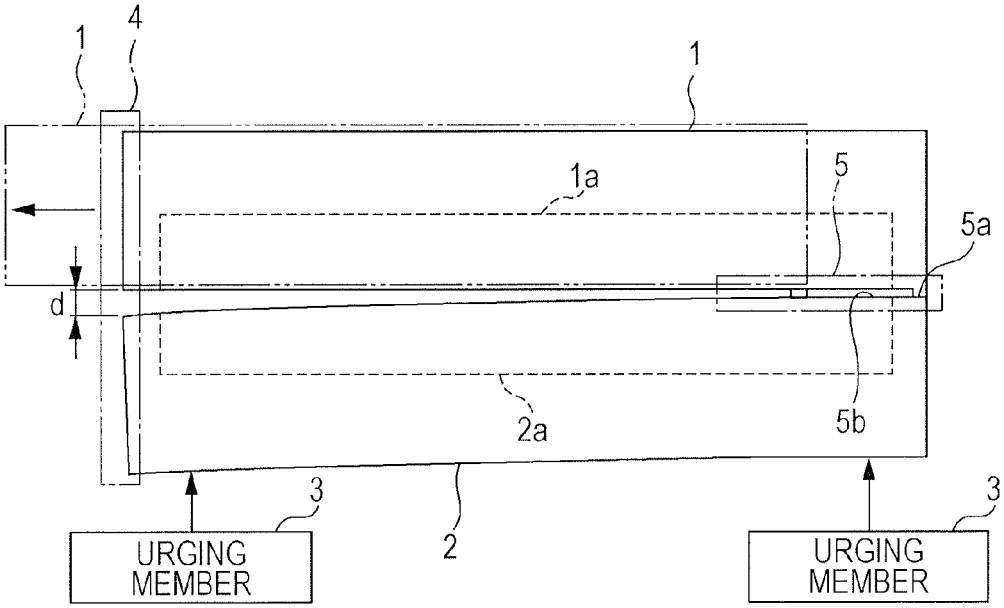
FIG. 1B illustrates an operational process in which an image holding body assembly is pulled.

In the present example, the process cartridge 12 includes an image holding body assembly 1, a developing assembly 2, urging members 3, a contacting and separating mechanism 4, and a gap forming mechanism 5. The image holding body assembly 1 is inserted into and pulled from the predetermined assembly receiving portion 11 and includes an image holding body 1*a*, which holds a latent image. The developing assembly 2 includes a developer holding body 2*a*, which hold a developer. The urging members 3 urge the developing assembly 2 so that the developer holding body 2*a* of the developing assembly 2 is pressed against both longitudinal ends of the image holding body 1*a* of the image holding body assembly 1. The contacting and separating mechanism 4 is disposed on a front side in an insertion and pulling direction of the image holding body assembly 1. When the contacting and separating mechanism 4 is operated in a predetermined direction, the image holding body assembly 1 and the developing assembly 2 are moved in a direction in which the image holding body assembly 1 and the developing assembly 2 are separated from each other against an urging forces applied by the urging members 3. The gap forming mechanism 5 forms a gap between the image holding body 1*a* and the developer holding body 2*a* as follows: as illustrated in FIG. 1B, when the image holding body assembly 1 is pulled in a pulling direction while the developing assembly 2 is separated from the image holding body assembly 1 by the contacting and separating mechanism 4, a rear end portion 5*a* of the image holding body assembly 1, the portion 5*a* located on the rear side in the insertion and pulling direction, is brought into contact with a guide portion 5*b*, which is provided on the developing assembly 2 and extends in the insertion and pulling direction. This forms the gap, the size of which is larger than a gap existing before the image holding body assembly 1 is pulled, between the image holding body assembly 1 and the developer holding body 2*a* on the rear side against the urging forces of the urging members 3.

In such a technical device, it is sufficient that the image holding body assembly 1 at least include the image holding body 1*a* that uses a photoconductor, a dielectric, or the like. Of course, the image holding body assembly 1 may also include a charging element and a cleaning element.

Of course, the developing assembly 2 may also include functioning elements such as a developer agitating member and a layer regulating member as long as the developing assembly 2 includes the developer holding body 2*a*. A developing method is not limited to a two-component developing method. Of course, a one-component developing method may be used.

Furthermore, the urging members 3 may be appropriately selected as long as the urging members 3 urge the developer holding body 2*a* so as to press the developer holding body 2*a* against both the longitudinal ends of the image holding body la. Urging positions may be different from the above-described positions as long as the urging forces applied by the urging members 3 do not vary.

Furthermore, the contacting and separating mechanism 4 may be appropriately selected as long as contacting and separating operations may be performed by an operation performed by the user. Although the principle of the contacting and separating mechanism 4 is not necessarily a rotational method, in which the contacting and separating mechanism 4 is rotated about a support point for rotation, ease of the operations may be realized with the rotational method.

It is sufficient that the gap forming mechanism 5 includes the rear end portion 5*a* of the image holding body assembly 1 and the guide portion 5*b* extending in the insertion and pulling direction of the developing assembly 2. Here, an initially engaging part of the guide portion 5*b* may have a structure that allows the portion 5*a* of the image holding body assembly 1 to be easily moved onto the guide portion 5*b*. Examples of such a structure include an inclination. It is sufficient that the gap formed by the gap forming mechanism 5 maintain a state in which the image holding body 1*a* and the developer holding body 2*a* are not in contact with each other. The size of this gap may be smaller than that of the gap formed by the contacting and separating mechanism 4.

Next, representative and other forms of the present exemplary embodiment are described.

Initially, examples of the forms of the gap forming mechanism 5 include a structure that forms a gap, the size of which is smaller than the following distance: that is, the distance between the image holding body 1*a* and the developer holding body 2*a* separated from each other by the contacting and separating mechanism 4 on the front side of the image holding body assembly 1.

Examples of a representative forms of such a gap forming mechanism 5 include a structure that includes the guide portion 5*b* and a projection (corresponding to the portion 5*a*) as follows: that is, the guide portion 5*b* is provided on the rear side of the developing assembly 2 and inclined so as to gradually reduce the distance between the guide portion 5*b* and the image holding body 1*a* toward the front side; and the projection is provided on the rear side of the image holding body 1*a*, projects toward the guide portion 5*b*, and is brought into contact with the guide portion 5*b* when the image holding body 1*a* is pulled in the pulling direction.

Examples of the representative forms of the contacting and separating mechanism 4 include a structure as follows: that is, a rotatable operation member (not illustrated) is provided on the front side of the developing assembly 2, the front side being in the insertion and pulling direction, a cam member, which is rotated along with the rotation of the operation member, is also provided, and the image holding body assembly 1 and the developing assembly 2 are brought into or out of contact with or from each other depending on the position of the cam member.

According to this form, the contacting and separating mechanism 4 includes the operation member and the cam member. When the operation member has a long arm, the contacting and separating operations of the developing assembly 2 may be performed with a reduced operational force. Furthermore, this contacting and separating mechanism 4 allows the urging members 3 to be easily integrated thereinto.

Exemplary embodiments of the present invention will be described in more detail below with reference to the drawings.

First Exemplary Embodiment

General Structure of Image Forming Apparatus

Figure 2:
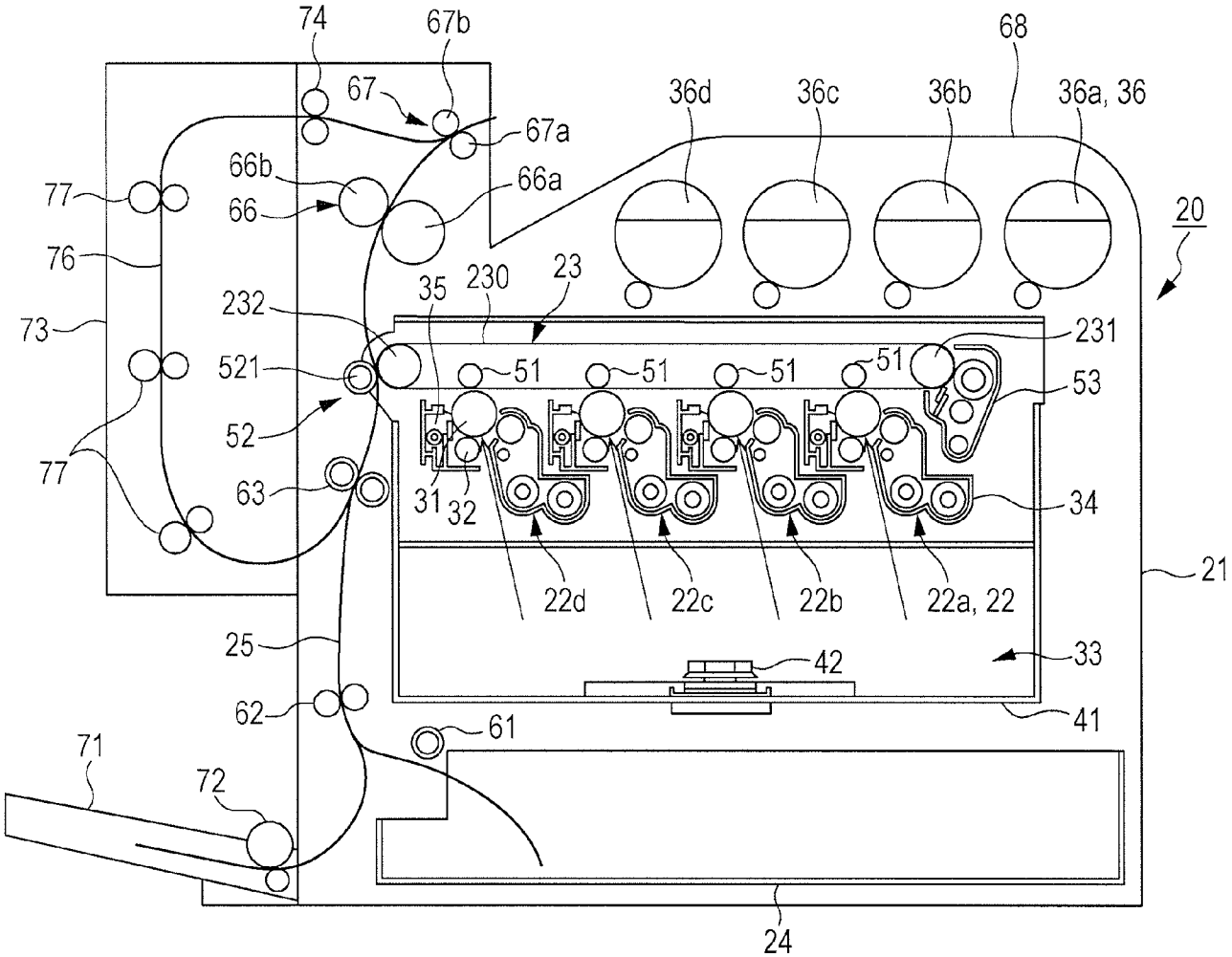
FIG. 2 illustrates an overall configuration of an image forming apparatus according to a first exemplary embodiment.

FIG. 2 illustrates a first exemplary embodiment of an image forming apparatus, to which the present invention is applied.

Referring to FIG. 2, an image forming apparatus 20 includes an apparatus housing 21, image forming units 22, a transfer module 23, a recording medium feeder 24, and a recording medium transport path 25. The image forming units 22 (specifically, 22*a* to 22*d*) of four colors (black, yellow, magenta, and cyan in the present exemplary embodiment) are arranged in the lateral direction in the apparatus housing 21. The transfer module 23 is disposed above the image forming units 22 and includes an intermediate transfer belt 230, which is moved in a circulating path in a direction in which the image forming units 22 are arranged. The recording medium feeder 24, which is disposed in a lower portion of the apparatus housing 21, contains recording media such as sheets. The recording medium transport path 25 extending from the recording medium feeder 24 is vertically disposed.

In the present exemplary embodiment, the image forming units 22 (22*a* to 22*d*) that respectively form, for example, black, yellow, magenta, and cyan toner images are sequentially arranged from the upstream side in the circulating direction of the intermediate transfer belt 230 (arrangement of the image forming units 22*a* to 22*d* are not necessarily in this order). The image forming units 22 each include a photoconductor body 31, a charger 32, an exposure device 33, a developing device 34, and a cleaner 35. The chargers 32 (charging rollers in the present example) charge the respective photoconductor bodies 31 in advance. The exposure device 33 (a single exposure device is shared by the image forming units 22 in the present example) writes electrostatic latent images onto the photoconductor bodies 31 charged by the chargers 32. The developing devices 34 develop the electrostatic latent images formed on the photoconductor bodies 31 with toner of the respective colors (for example, the negative polarity in the present exemplary embodiment). The cleaners 35 clean matter remaining on the photoconductor bodies 31.

Here, the exposure device 33 includes, for example, four semiconductor lasers (not illustrated), one polygon mirror 42, an imaging lens (not illustrated), and mirrors (not illustrated) housed in an exposure housing 41. The mirrors correspond to the respective photoconductor bodies 31. The polygon mirror 42 deflects light from the semiconductor lasers of color components to scan the respective photoconductor bodies 31 so that light images are directed to exposure points on the respective photoconductor bodies 31 through the imaging lens and the mirrors.

Reference sign 36 (36*a* to 36*d*) denotes toner cartridges that replenish the respective developing device 34 with the toner of the respective colors.

In the present exemplary embodiment, the transfer module 23 uses, for example, the intermediate transfer belt 230 and a pair of tension rollers 231 and 232 (one of the rollers is a drive roller). The intermediate transfer belt 230 is looped over the pair of tension rollers 231 and 232. First transfer devices (first transfer rollers in the present example) 51 are disposed on the rear surface side of the intermediate transfer belt 230 at positions corresponding to the photoconductor bodies 31 of the respective image forming units 22. By applying to the first transfer devices 51 a voltage of a polarity opposite to the polarity to which the toner is charged, the toner images on the photoconductor bodies 31 are electrostatically transferred onto the intermediate transfer belt 230 side.

Furthermore, a second transfer device 52 is disposed at a position corresponding to the tension roller 232 downstream of the downstream-most image forming unit 22*d* in the circulating direction of the intermediate transfer belt 230. First transfer images on the intermediate transfer belt 230 are transferred onto the recording medium through second transfer (collective transfer).

In the present exemplary embodiment, the second transfer device 52 includes a second transfer roller 521 and a backup roller (in the present example, also used as the tension roller 232). The second transfer roller 521 is pressed against a toner image holding surface side of the intermediate transfer belt 230. The backup roller is disposed on the rear surface side of the intermediate transfer belt 230 and serves as a counter electrode of the second transfer roller 521.

For example, the second transfer roller 521 is grounded and the backup roller (tension roller 232) is applied with a bias, the polarity of which is the same as the polarity to which the toner is charged.

Furthermore, a belt cleaner 53 is disposed upstream of the upstream-most image forming unit 22*a* in the circulating direction of the intermediate transfer belt 230. The belt cleaner 53 removes the toner remaining on the intermediate transfer belt 230.

A supply roller 61 that supplies the recording medium is provided in the recording medium feeder 24. A transport roller 62 that transports the recording medium is disposed immediately downstream of the supply roller 61 in a recording medium transport direction. In addition, a registration roller 63 is disposed at a position immediately upstream of a second transfer position in the recording medium transport direction in the recording medium transport path 25. The registration roller 63 supplies the recording medium to the second transfer position at specified timing.

A fixing device 66 is provided downstream of the second transfer position in the recording medium transport direction in the recording medium transport path 25. The fixing device 66 includes, as illustrated in FIG. 2, a heating fixing roller 66*a*, which includes a heater (not illustrated), and a pressure fixing roller 66*b*, which is pressed against the heating fixing roller 66*a* and rotated by the heating fixing roller 66*a*. A recording medium ejection device 67 is provided downstream of the fixing device 66 in the recording medium transport direction. The recording medium ejection device 67 includes a pair of ejection rollers 67*a* and 67*b* that eject the recording medium from the apparatus housing 21. The recording medium ejection device 67 pinches and transports the recording medium so as to eject the recording medium, which is received by a recording medium receiving unit 68 formed in an upper portion of the apparatus housing 21.

Furthermore, in the present exemplary embodiment, a manual sheet inserter (MSI) 71 is provided in a laterally side portion of the apparatus housing 21. The recording medium placed on the manual sheet inserter 71 is supplied toward the recording medium transport path 25 by a supply roller 72.

Furthermore, a duplex module 73 is disposed in the apparatus housing 21. When a duplex mode, in which images are recorded on both sides of the recording medium, is selected, the duplex module 73 inverts the rotation of the recording medium ejection device 67, moves the recording medium, one side of which has already undergone recording, inward by a guide roller 74 positioned in front of an entrance, transports the recording medium along a recording medium return path 76 therein with an appropriate number of transport rollers 77, and supplies the recording medium toward the registration roller 63 again.

Process Cartridge

Figure 3:
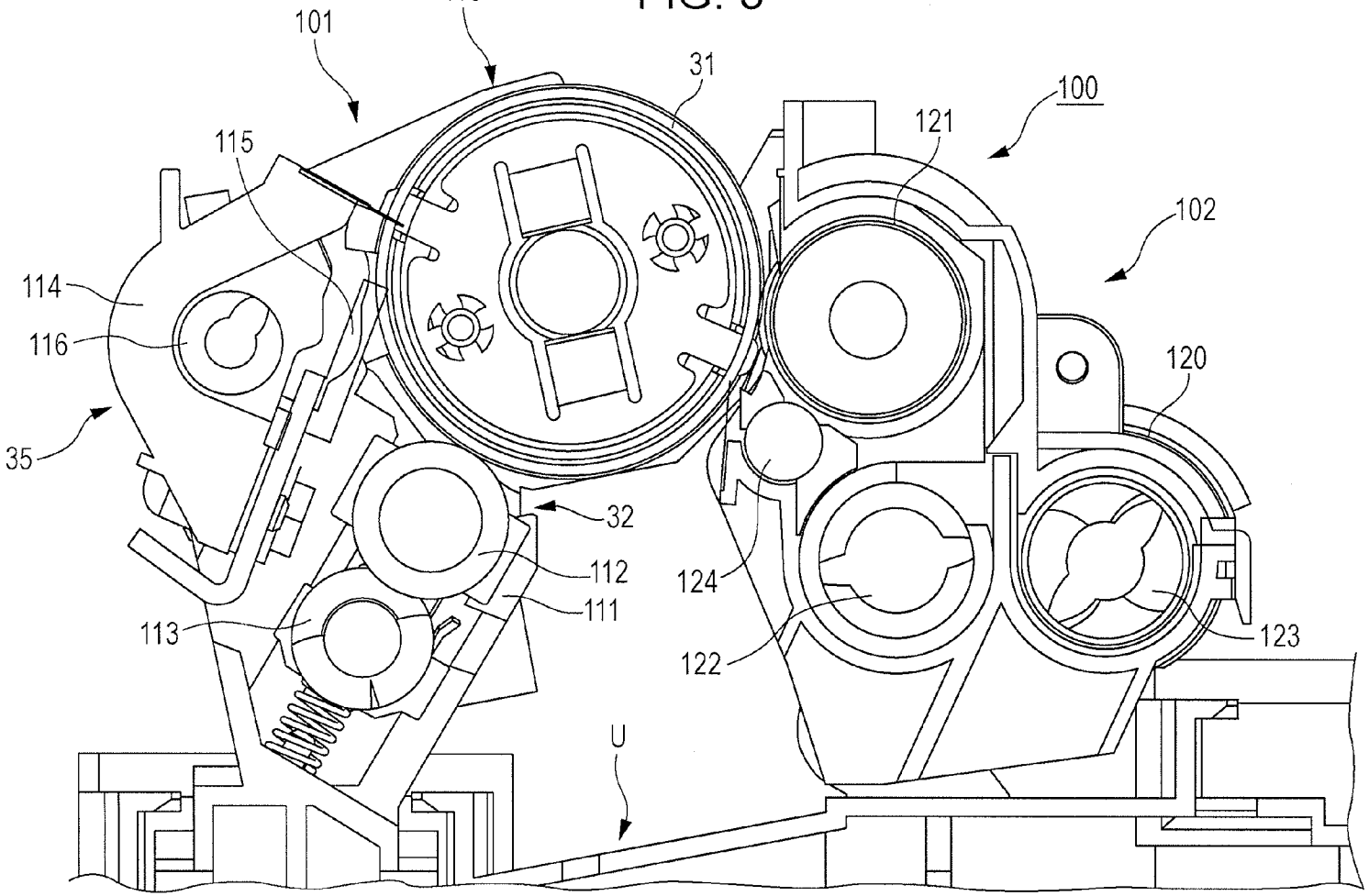
FIG. 3 illustrates an example of a configuration of a process cartridge of the image forming apparatus according to the first exemplary embodiment.
Figure 4:
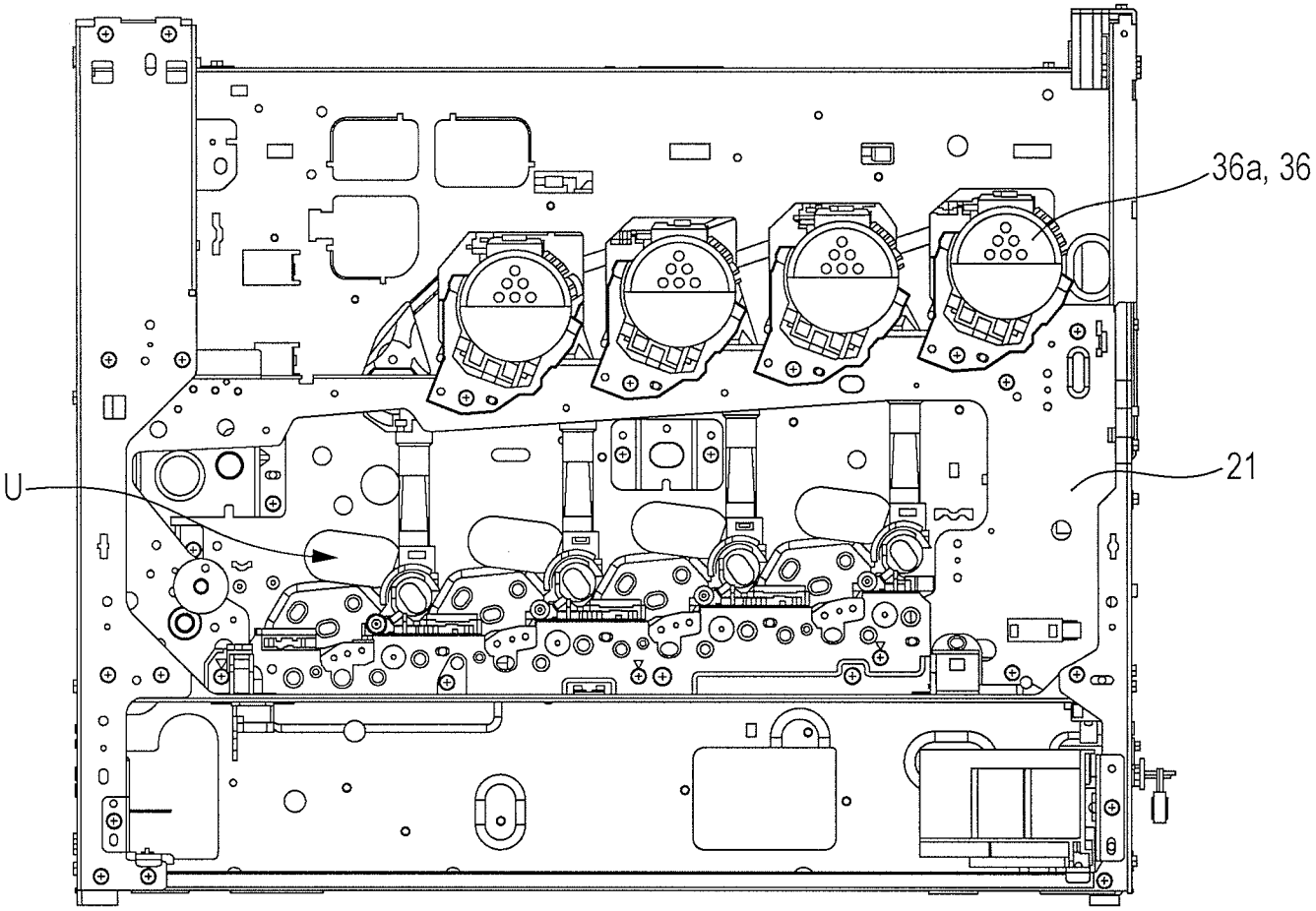
FIG. 4 is a front view illustrating a portion of the image forming apparatus according to the first exemplary embodiment to which the process cartridge is attached.
Figure 5:
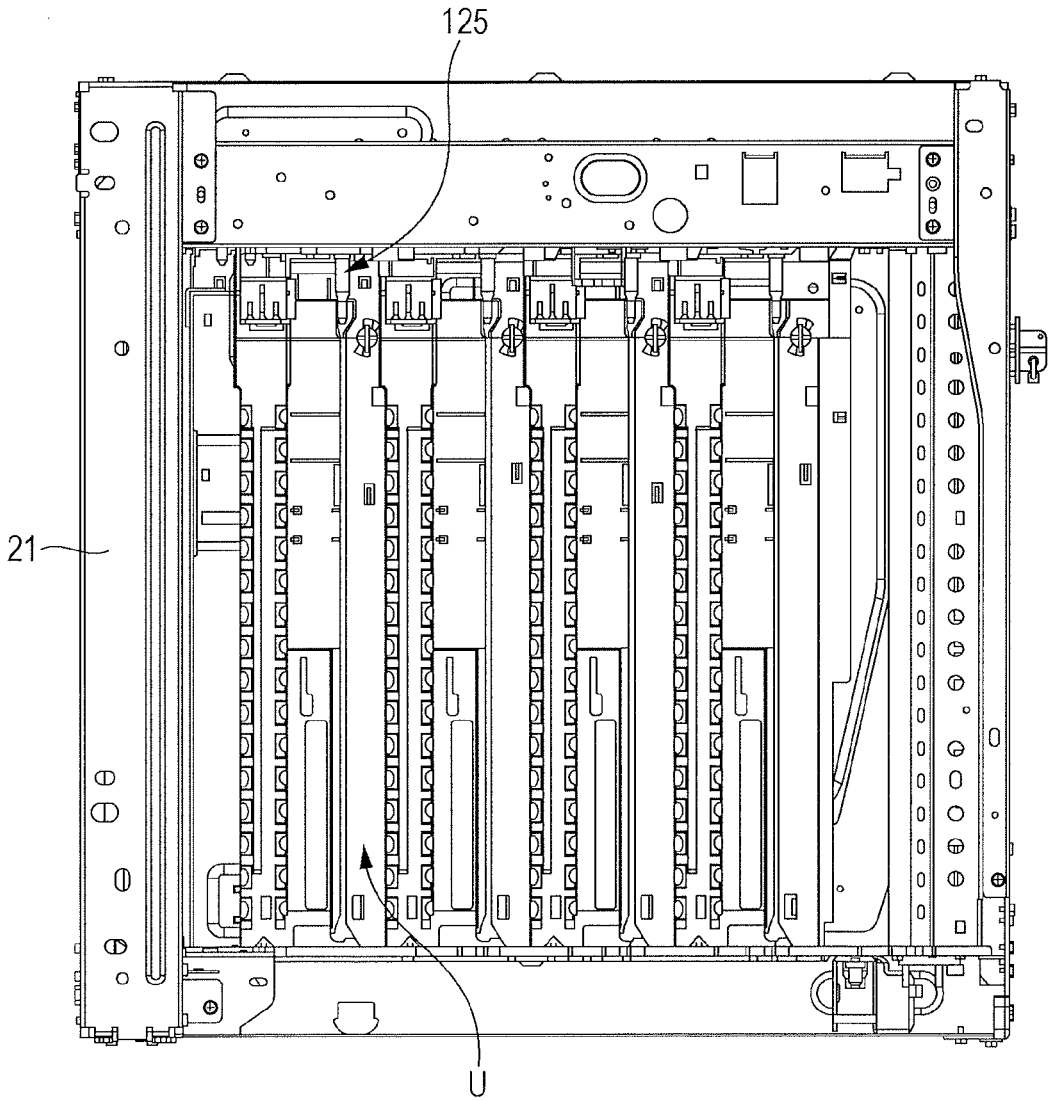
FIG. 5 is a plan view illustrating the portion, to which the process cartridge is attached, illustrated in FIG. 4.

In the present exemplary embodiment, as illustrated in FIGS. 3 to 5, each of the image forming units 22 is configured as a process cartridge 100, into which the photoconductor body 31, the charger 32, the developing device 34, and the cleaner 35 are integrated and which is detachably attached to a corresponding one of assembly receiving portions U of the apparatus housing 21.

Particularly in the present example, the process cartridge 100 includes a photoconductor body assembly 101, into which the photoconductor body 31 is integrated, and a developing assembly 102, which opposes the photoconductor body assembly 101 and into which the developing device 34 is integrated. Thus, the photoconductor body assembly 101 and the developing assembly 102 are attached to and detached from the corresponding assembly receiving portion U of the apparatus housing 21. Particularly in the present example, by considering the difference in lives of the photoconductor body assembly 101 and the developing assembly 102, the photoconductor body assembly 101 and the developing assembly 102 are separately detachably attached to the assembly receiving portion U. For example, in the case where only the photoconductor body assembly 101 of the process cartridge 100 is replaced, the photoconductor body assembly 101 may be pulled out while the developing assembly 102 is left in the assembly receiving portion U of the apparatus housing 21, and then a new photoconductor body assembly 101 may be inserted.

Photoconductor Body Assembly

In the present example, as illustrated in FIG. 3, the photoconductor body assembly 101 includes a container 110 that houses the photoconductor body 31. The charger 32 and the cleaner 35 are disposed around the photoconductor body 31 in the container 110.

Here, both ends of a rotational shaft of the photoconductor body 31 are rotatably supported by both ends of the container 110. When the photoconductor body assembly 101 is attached, one of the ends of the rotational shaft of the photoconductor body 31 is connected for drive to a drive mechanism (not illustrated).

The charger 32 is configured as follows: A charger containing portion 111 is provided in part of the container 110. A charging roller 112 and a power supply roller 113 are provided in the charger containing portion 111. The charging roller 112 is in contact with or in the proximity of a surface of the photoconductor body 31, and the power supply roller 113 supplies power to the charging roller 112.

The cleaner 35 is configured as follows: A cleaner containing portion 114 is provided in part of the container 110. A plate-shaped cleaning member 115 is provided at an edge of an opening of the cleaner containing portion 114, and a collection and transport member (in the form of, for example, a rotational shaft having a spiral blade formed therearound) 116 is disposed in the cleaner containing portion 114. The cleaning member 115 scrapes off residual toner from the surface of the photoconductor body 31, and the collection and transport member 116 transports the residual toner having been scraped off by the cleaning member 115 toward a collection container (not illustrated).

Developing Assembly

As illustrated in FIG. 3, the developing assembly 102 includes a developing container 120 that has an opening toward the photoconductor body 31 and contains the two-component developer containing a toner and carrier. A developing roller 121, which holds and transports the developer, is disposed at a position of the developing container 120 opposite the opening. A pair of developer agitating members (each in the form of, for example, a rotational shaft having a spiral blade therearound) 122 and 123 are disposed on the rear surface side of the developing roller 121 in the developing container 120. Furthermore, a layer thickness regulating member (for example, a layer thickness regulating roller) 124, which regulates the thickness of a layer of the developer held by the developing roller 121, is provided on the upstream side of a developing position in the rotational direction of the developing roller 121.

Also in the present example, as illustrated in FIGS. 4 and 5, a pivot shaft 125 is provided on the rear side of the assembly receiving portions U of the apparatus housing 21. The pivot shaft 125 is inserted into a bearing portion 126 provided on the rear side of the developing container 120. Thus, the developing assembly 102 is swingable about the pivot shaft 125, which is a rotational support, of the developing container 120.

Figure 8:
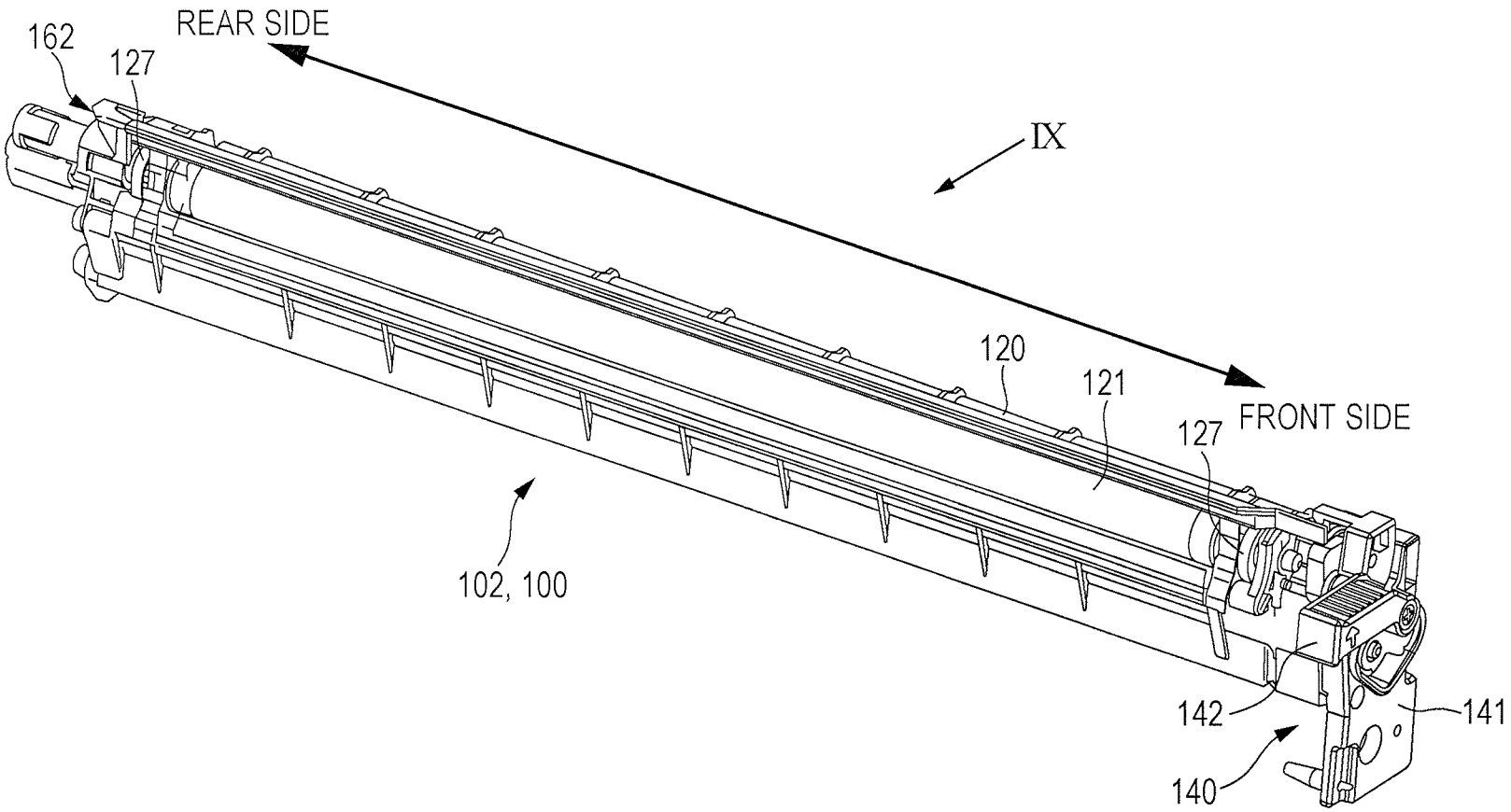
FIG. 8 is a perspective view illustrating an overall configuration of a developing assembly (developing device) used in the first exemplary embodiment.
Figure 9:
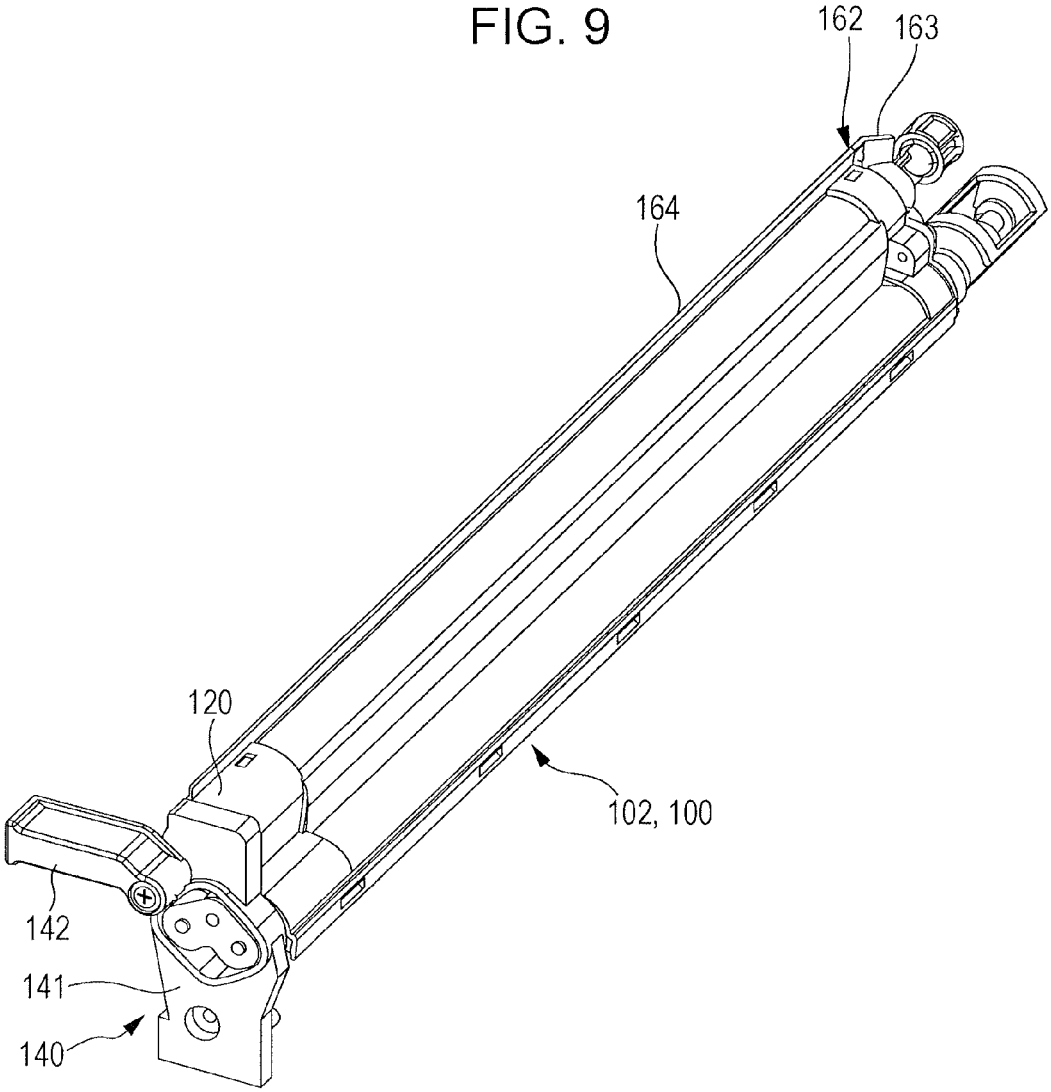
FIG. 9 is a perspective view of the developing assembly illustrated in FIG. 8 seen in a IX direction.
Figure 10:
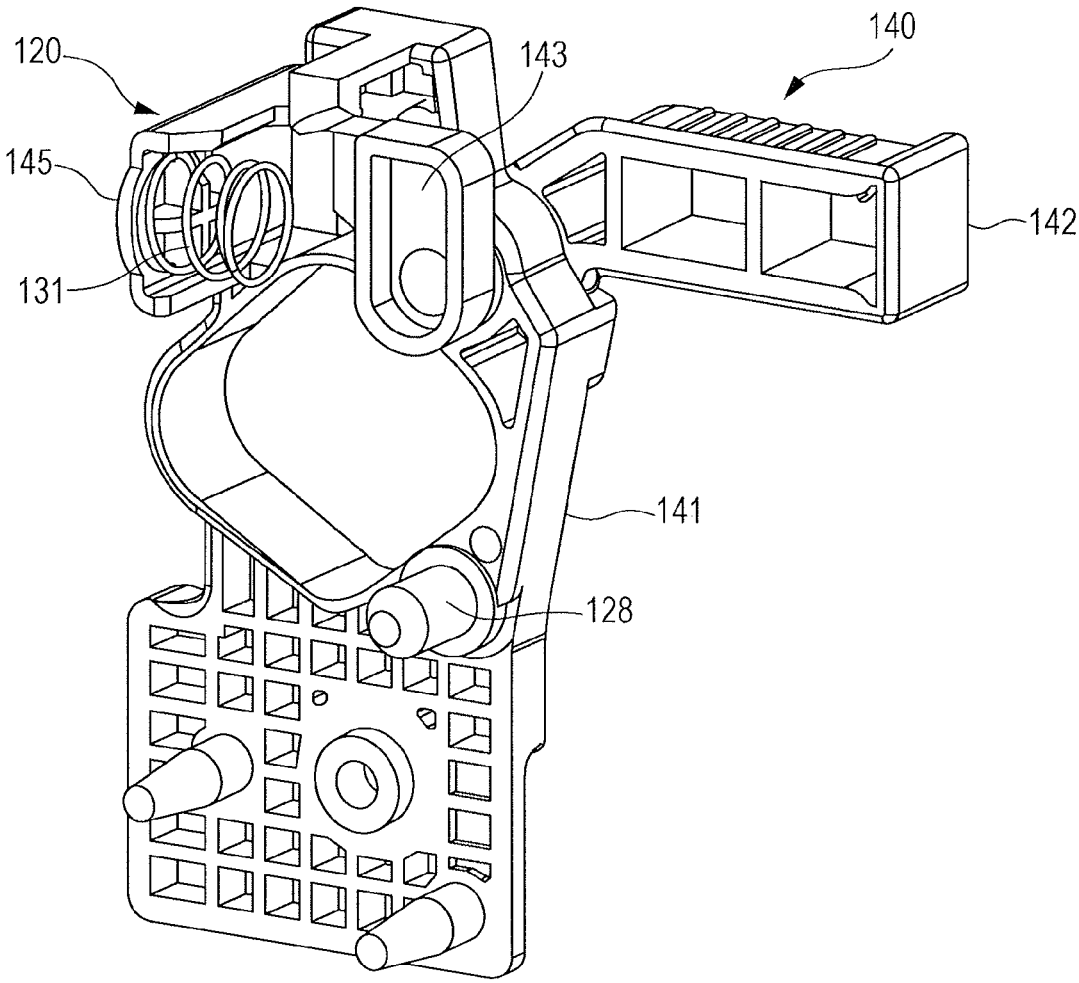
FIG. 10 illustrates an example of a retraction mechanism provided on the front side of the developing assembly.
Figure 11:
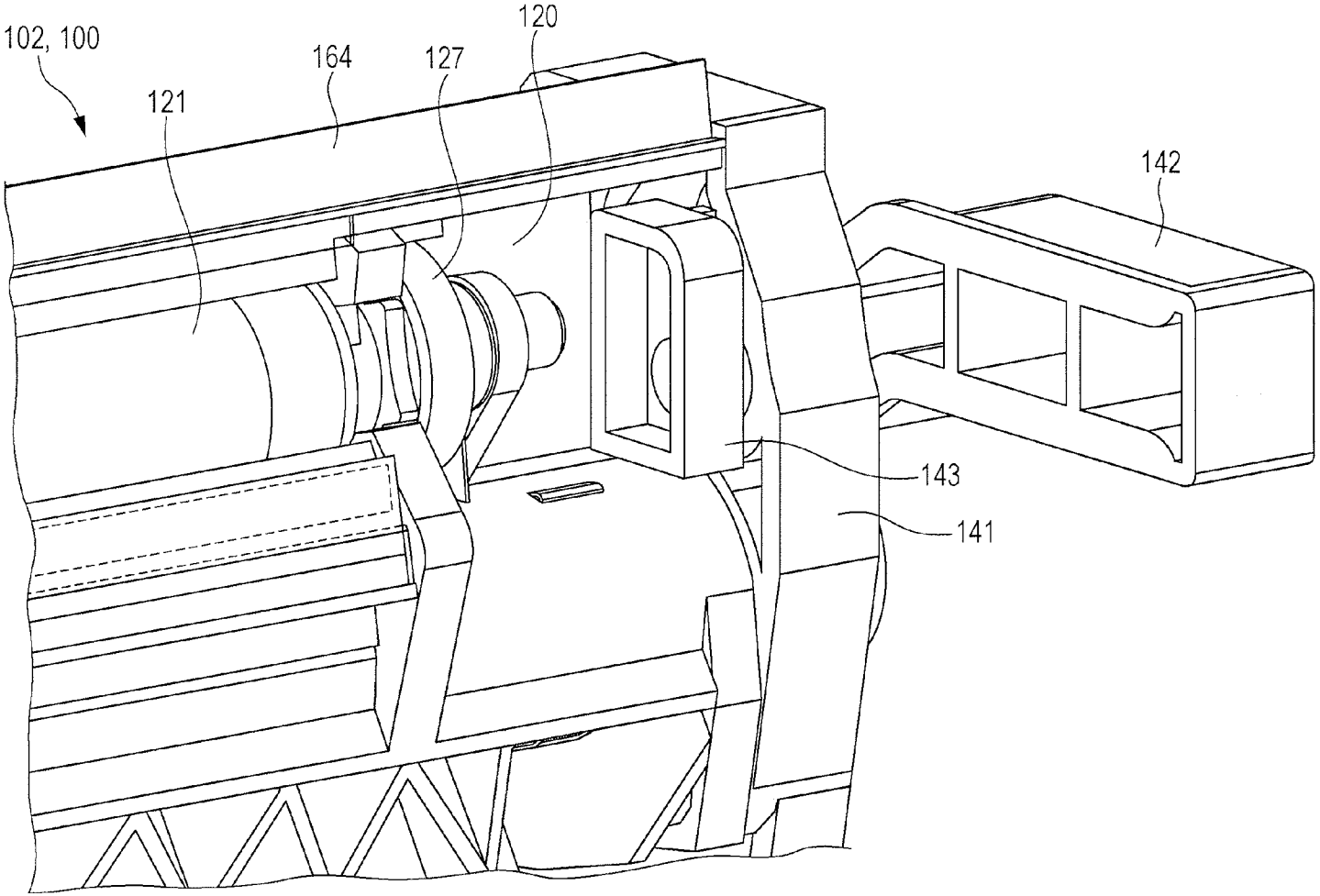
FIG. 11 illustrates an enlarged view of the retraction mechanism illustrated in FIG. 10.
Figure 12:
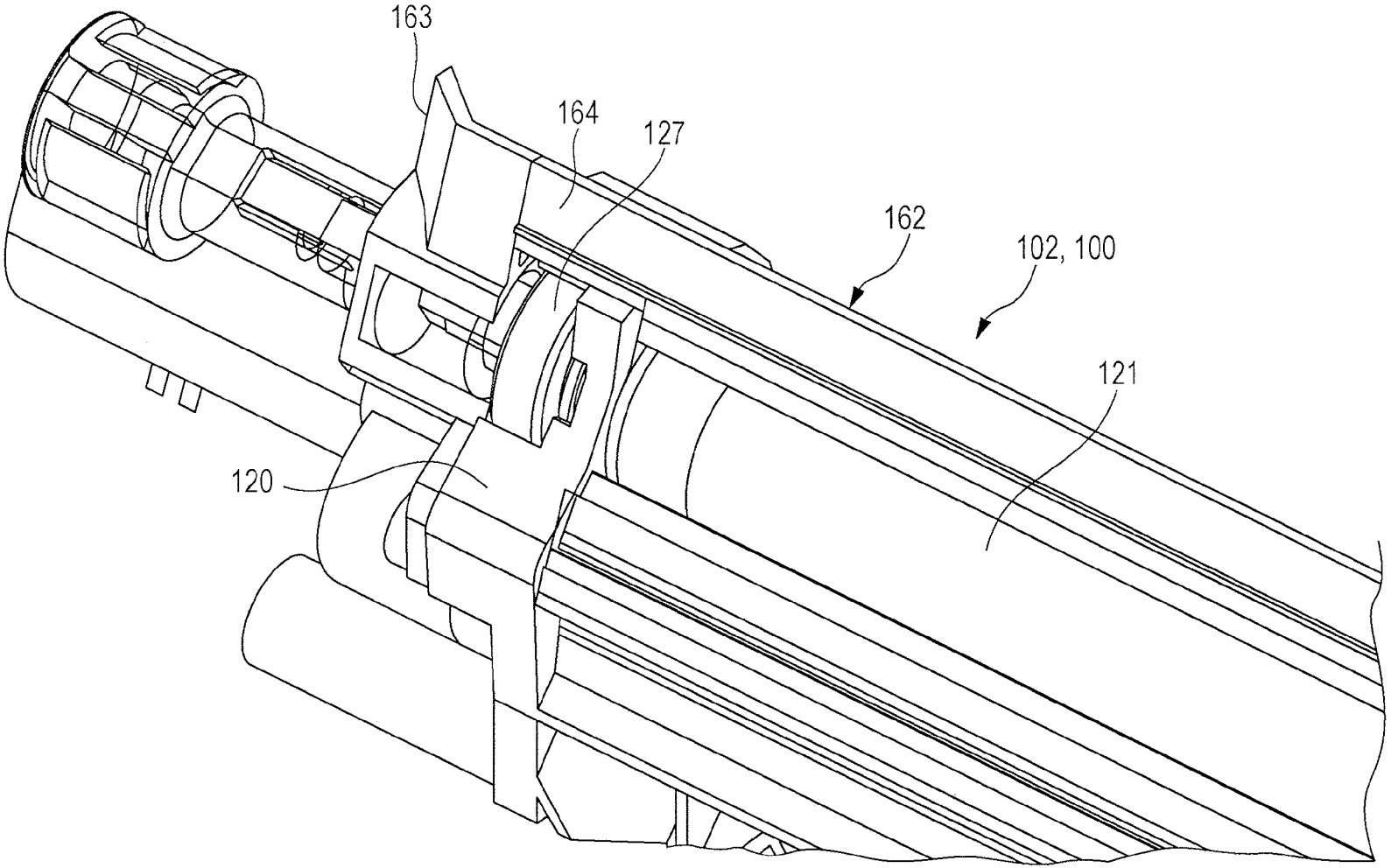
FIG. 12 illustrates an example of a guide portion provided along the developing assembly from the rear side to the front side of the developing assembly.

Also in the present example, as illustrated in FIG. 8, tracking rollers 127 are provided at both ends of the developing roller 121. The tracking rollers 127 have a diameter slightly larger than that of the developing roller 121 and are used to adjust the position. By bringing the tracking rollers 127 into contact with the surface of the photoconductor body 31, the gap between the developing roller 121 and the photoconductor body 31 is adjusted to a predetermined specified size.

Figure 6:
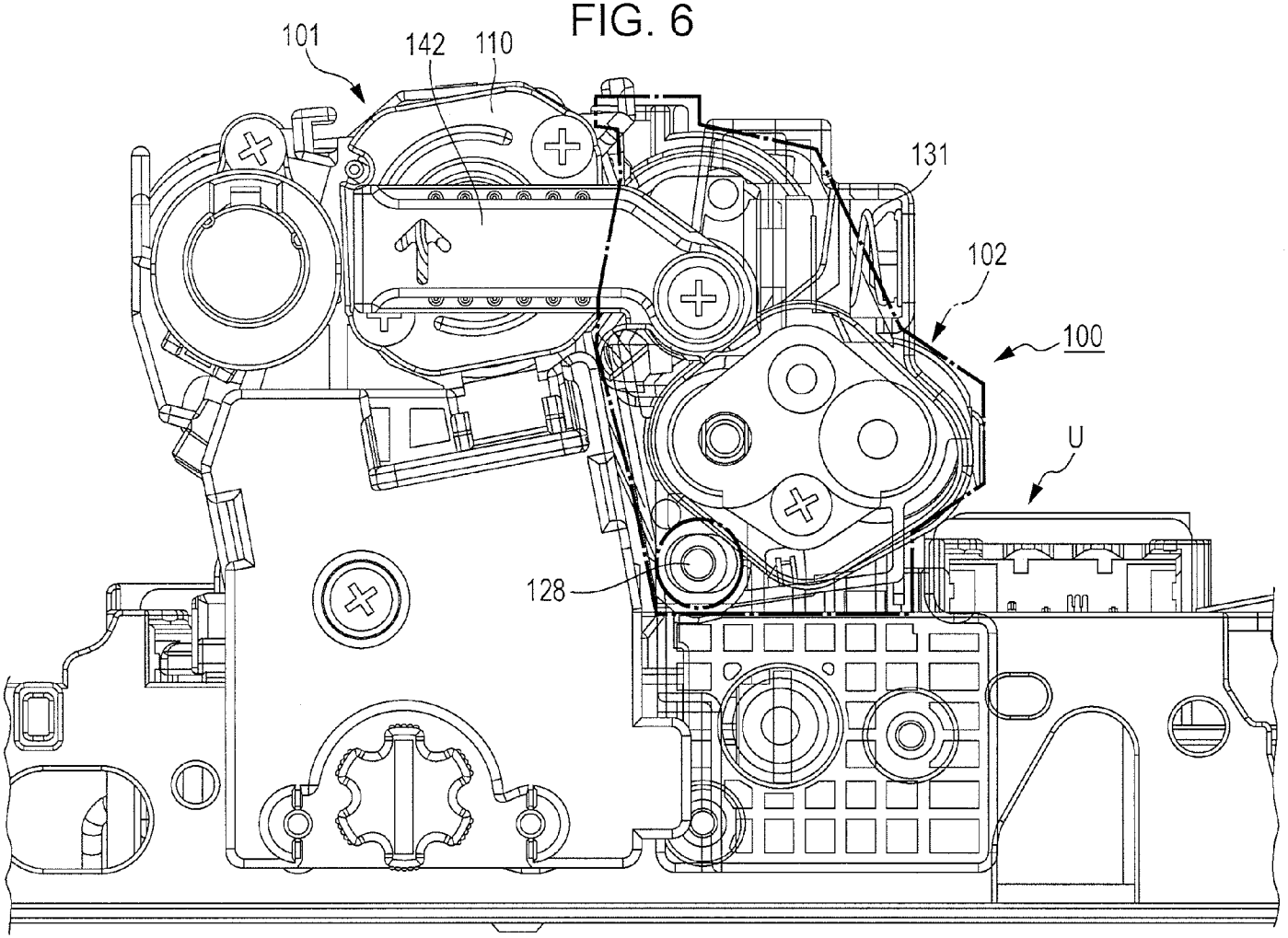
FIG. 6 illustrates a state, in which the process cartridge according to the first exemplary embodiment is set, seen from the front side.
Figure 7:
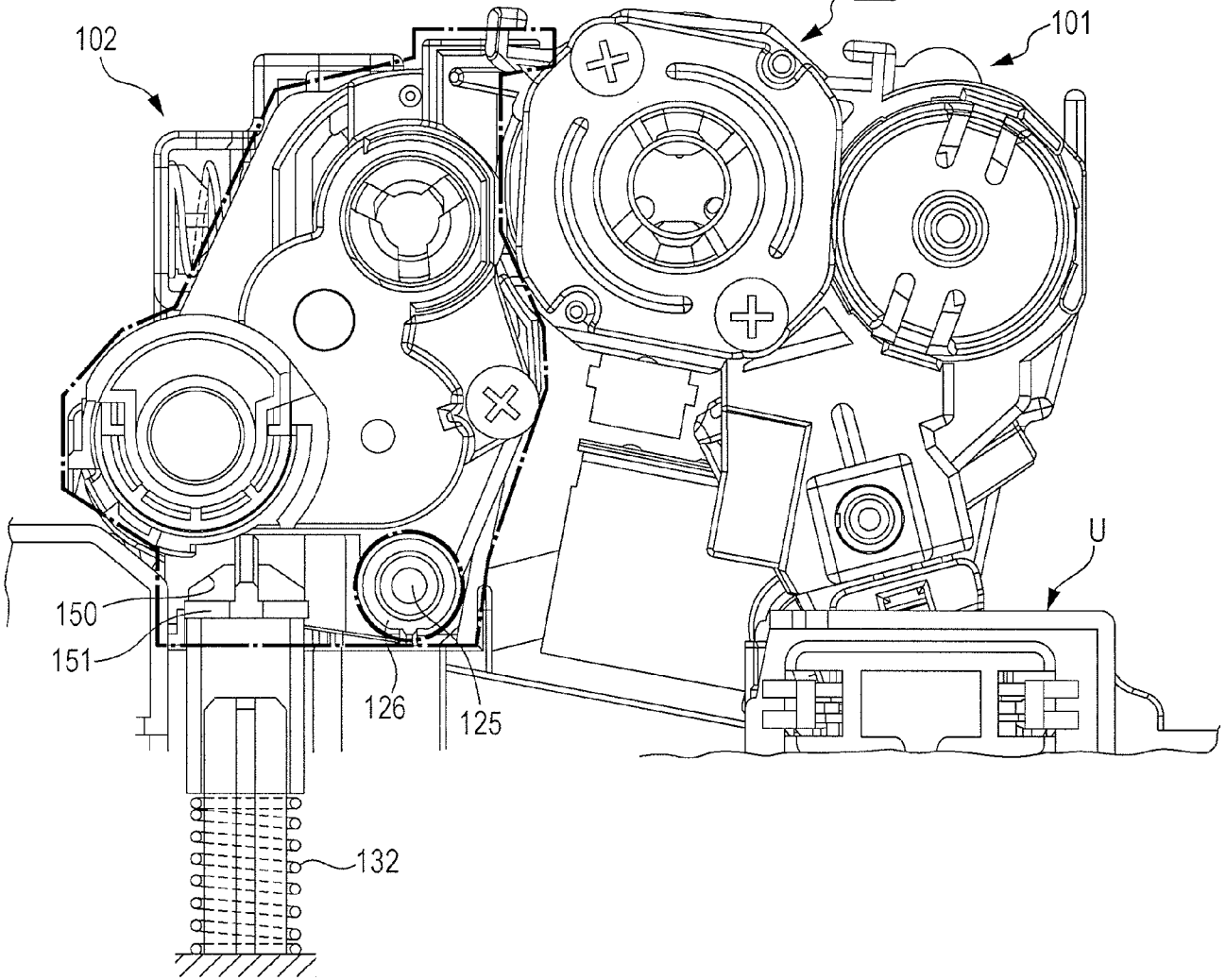
FIG. 7 illustrates a state illustrated in FIG. 6, in which the process cartridge is set, seen from the rear side.

Furthermore, as illustrated in FIGS. 6 and 7, the developing assembly 102 is urged toward the photoconductor body assembly 101 at positions near both longitudinal ends of the developing assembly 102 by urging springs 131 and 132. Thus, the positional relationship between the developing assembly 102 and the photoconductor body assembly 101 are maintained with the tracking rollers 127 in contact with the photoconductor body 31.

Retraction Mechanism

As illustrated in FIGS. 8 to 12, a retraction mechanism 140 serving as the contacting and separating mechanism that increases the distance between the developing assembly 102 and the photoconductor body assembly 101 is provided on the front side of the developing assembly 102 in the longitudinal direction of the developing assembly 102.

The retraction mechanism 140 includes a holder 141 that holds the front side of the developing container 120 of the developing assembly 102. The holder 141 is secured to part of the assembly receiving portion U of the apparatus housing 21 with the rotation thereof being locked. The holder 141 includes a pivot shaft 128, which is inserted into a bearing portion (not illustrated) formed on the front side in the longitudinal direction of the developing container 120. The developing container 120 is rotatably held at its front side in its longitudinal direction by the holder 141.

In the present example, a rotatable operation lever 142 is provided on the front surface side of the holder 141, and a cam member 143, which is rotated by an operation of the operation lever 142, is provided on the rear surface side of the holder 141. In accordance with the relationship between the cam member 143 and an inner wall 144 of the developing container 120 when the operation lever 142 is rotated in a direction indicated in FIG. 14, the developing container 120 is separated from the photoconductor body assembly 101 in a rotation about the pivot shaft 128. The details of operational processes of the retraction mechanism will be described later.

Urging Method with Urging Spring

In the present example, a spring receiving portion 145 is provided on the rear surface side of the holder 141 of the retraction mechanism 140. The one urging spring 131 of the urging springs 131 and 132 is attached to the spring receiving portion 145 so as to directly urge the developing assembly 102 toward the photoconductor body assembly 101 in a lateral direction.

Furthermore, as illustrated in FIG. 7, in each of the assembly receiving portions U of the apparatus housing 21, the other urging spring 132 urges the developing assembly 102 upward at a position on the rear side of the developing assembly 102 in the longitudinal direction of the developing assembly 102. Thus, the developing assembly 102 is pressed against the photoconductor body assembly 101 in a rotation about the pivot shaft 125 of the developing assembly 102.

Particularly in the present example, a positioning hole 150 is provided in a bottom surface of the developing container 120 of the developing assembly 102. A plunger 151, which is urged by the urging spring 132, is engaged with the positioning hole 150, thereby the plunger 151 is positioned. In a retracting operation with the retraction mechanism 140, while the front side of the developing assembly 102 in the longitudinal direction of the developing assembly 102 is being retracted from the photoconductor body assembly 101, the retraction on the rear side of the developing assembly 102 in the longitudinal direction of the developing assembly 102 is stopped when a force of the urging spring 132 and the amount of the torsion of the developing container 120 are balanced.

Gap Forming Mechanism

In the present exemplary embodiment, the retraction mechanism 140 is provided on the front side of the developing assembly 102 in the longitudinal direction of the developing assembly 102. The retracting operation with the retraction mechanism 140 on the front side of the developing assembly 102 in the longitudinal direction of the developing assembly 102 is not directly transmitted to the rear side of the developing assembly 102 in the longitudinal direction of the developing assembly 102.

For this reason, in the present exemplary embodiment, a gap forming mechanism 160 is provided so as to form a gap between the developing roller 121 and the photoconductor body 31 on the rear side of the photoconductor body assembly 101 in the longitudinal direction of the photoconductor body assembly 101 when, for example, the photoconductor body assembly 101 is pulled after the retracting operation with the retraction mechanism 140 has been performed. The size of the gap is larger than that of the gap formed before the photoconductor body assembly 101 is pulled.

Figure 13:
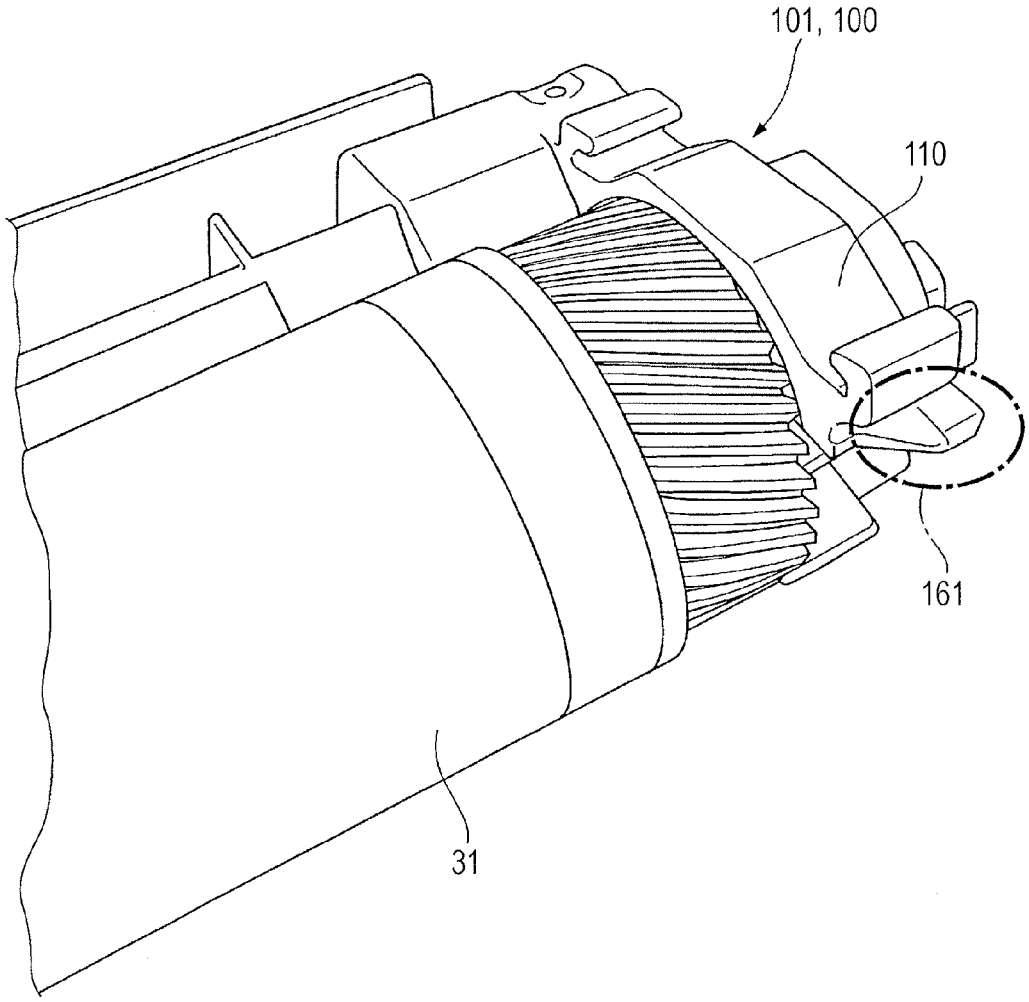
FIG. 13 illustrates an example of a configuration of the rear side of the photoconductor body assembly.

This gap forming mechanism 160 includes a projection 161 and a guide rail 162. The projection 161 that projects toward the developing assembly 102 is provided, as illustrated in FIGS. 7 and 13, on the rear side of the photoconductor body assembly 101 in the longitudinal direction of the photoconductor body assembly 101, and more specifically, provided at part of the container 110. As illustrated in FIGS. 8, 9, 11, and 12, the guide rail 162 is disposed on the developing container 120 of the developing assembly 102 and extends from the rear side to the front side in the longitudinal direction of the developing container 120.

In the present example, the guide rail 162 includes a linear guide portion 164 and an inclined guide portion 163. The linear guide portion 164 linearly extends from the rear side to the front side of the developing container 120 in the longitudinal direction. The inclined guide portion 163 is disposed on the rear side of the linear guide portion 164 in the longitudinal direction and inclined such that the distance between the inclined guide portion 163 and the photoconductor body assembly 101 gradually reduces toward the linear guide portion 164 on the front side.

Here, when the photoconductor body assembly 101 is attached to a predetermined position (set position) in the assembly receiving portion U of the apparatus housing 21, it is required that the projection 161 of the photoconductor body assembly 101 be not in contact with the inclined guide portion 163 of the guide rail 162 of the developing assembly 102.

It is required that the projection 161 of the photoconductor body assembly 101 be brought into contact with the inclined guide portion 163 of the developing assembly 102 as the photoconductor body assembly 101 in the above-described state is pulled from the assembly receiving portion U of the apparatus housing 21. It is sufficient that, as the photoconductor body assembly 101 is pulled further, the projection 161 of the photoconductor body assembly 101 be moved on the inclined guide portion 163 and moved onto the linear guide portion 164. In this state, the projection 161 of the photoconductor body assembly 101 is guided along the guide rail 162 of the developing assembly 102. In accordance with the relationship between the projection 161 and the guide rail 162, a specified gap g is formed between the photoconductor body 31 and the developing roller 121.

It is sufficient that the size of the gap g sufficiently maintain a state in which the photoconductor body 31 and the developing roller 121 are not in contact with each other. This size may be smaller than the distance by which the front side of the developing roller 121 in the longitudinal direction of the developing roller 121 is retracted from the photoconductor body 31 with the retraction mechanism 140.

Attachment and Detachment of Process Cartridge

Here, it is assumed that, for example, the photoconductor body assembly 101 of the process cartridge 100 is pulled from the process cartridge 100, which is attached to the assembly receiving portion U of the apparatus housing 21. Operational processes of the pulling of the photoconductor body assembly 101 are described as follows.

(1) Retracting Operation with Retraction Mechanism

In order to pull the photoconductor body assembly 101 of the process cartridge 100, it is required that the retracting operation with the retraction mechanism 140 be initially performed.

Figure 14:
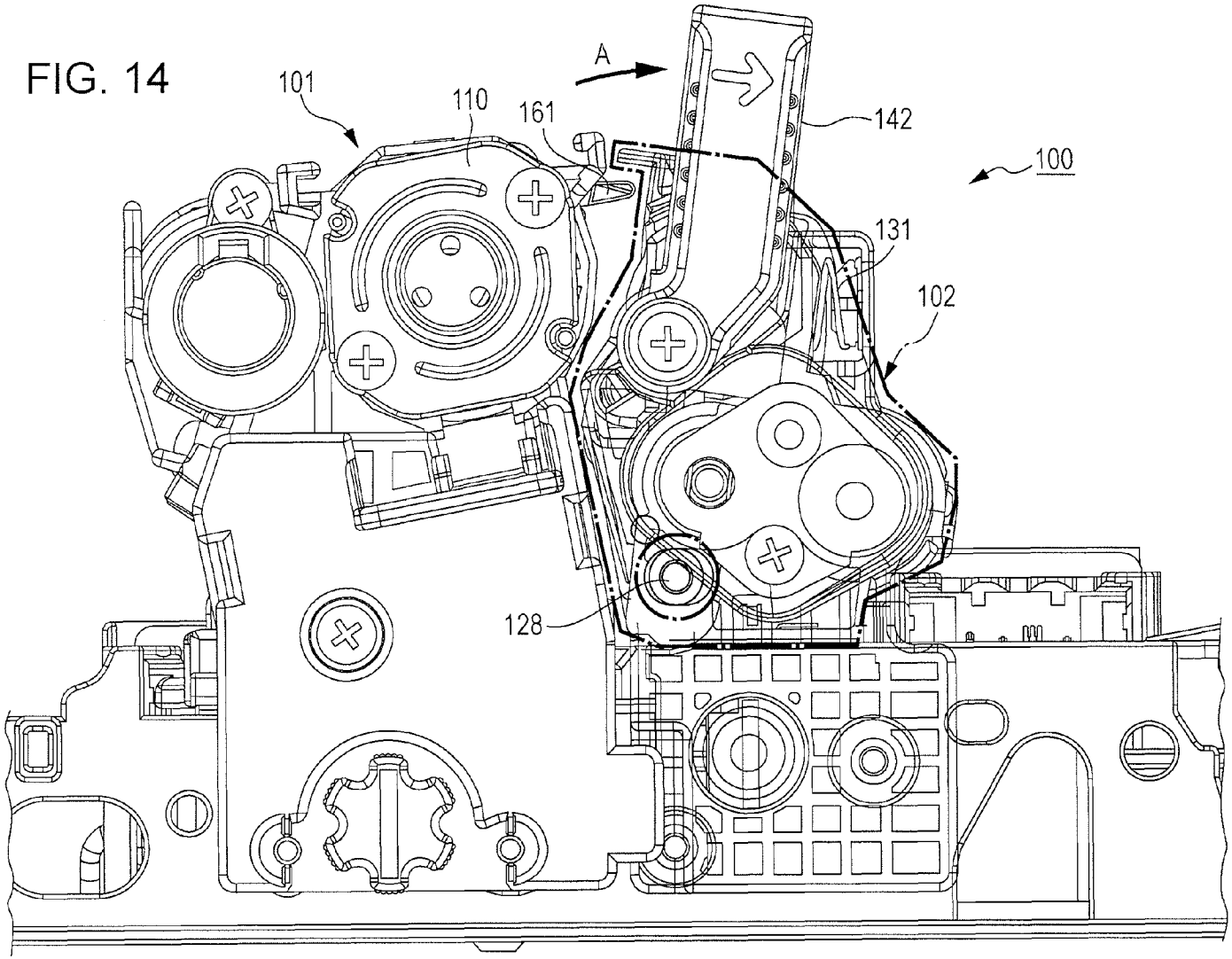
FIG. 14 illustrates an example of an operation in which the photoconductor body assembly of the process cartridge is pulled in the image forming apparatus according to the first exemplary embodiment.

As illustrated in FIG. 14, it is sufficient that the retracting operation with the retraction mechanism 140 be performed by rotating the operation lever 142 of the retraction mechanism 140 in an arrow A direction.

Figure 15:
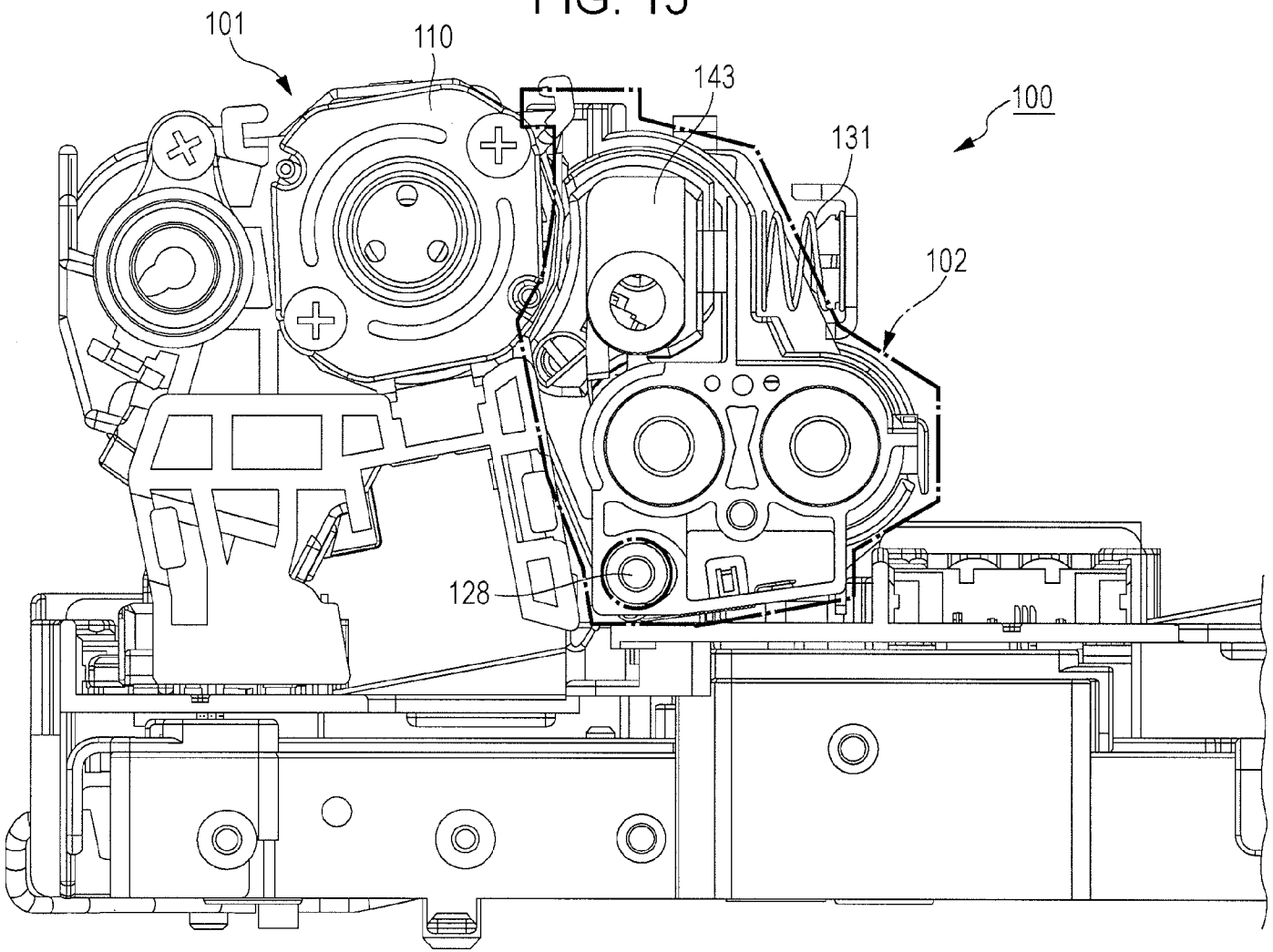
FIG. 15 illustrates an operational process (1) of retracting the developing assembly with the retraction mechanism used in the first exemplary embodiment.
Figure 16:
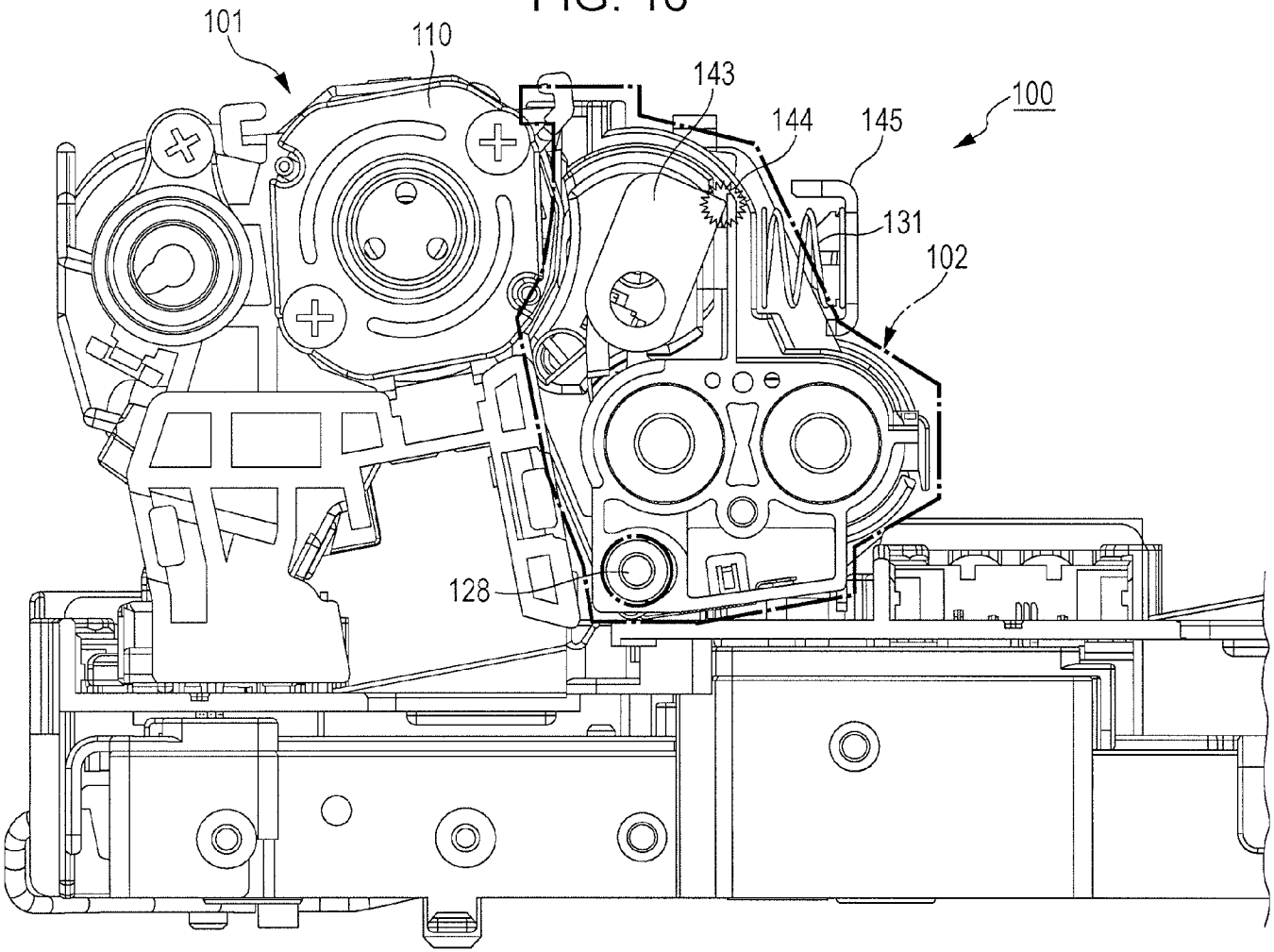
FIG. 16 illustrates an operational process (2) of retracting the developing assembly with the retraction mechanism illustrated in FIG. 15.
Figure 17:
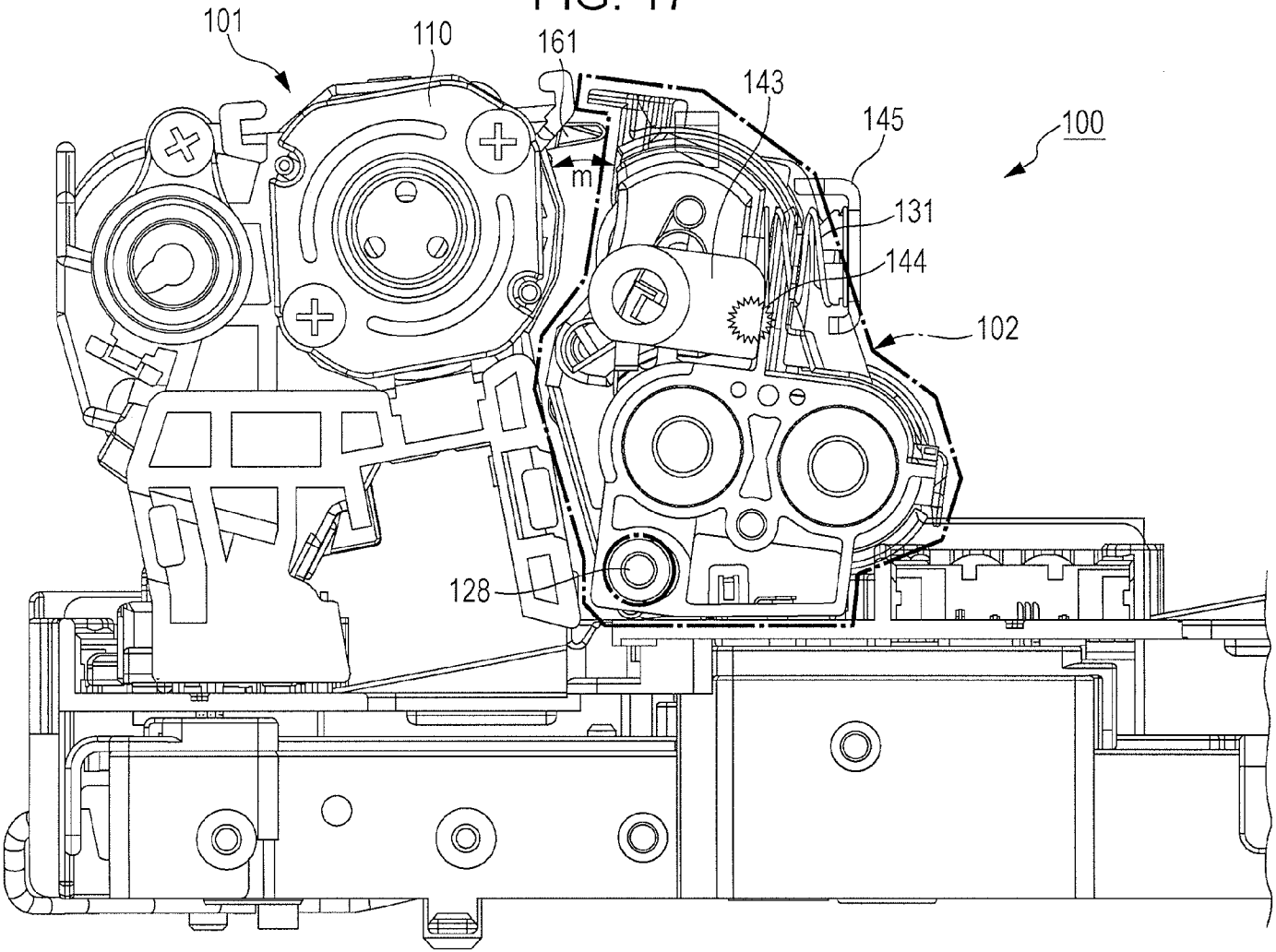
FIG. 17 illustrates an operational process (3) of retracting the developing assembly with the retraction mechanism illustrated in FIG. 15.

At this time, as illustrated in FIGS. 15 to 17, as the operation lever 142 is rotated, the cam member 143 of the retraction mechanism 140 is rotated in the same direction as that of the rotation of the operation lever 142. As a result, a corner portion of a rotational free end of the cam member 143 interferes with the inner wall 144 (a blocking wall that opposes the photoconductor body assembly 101 and substantially vertically extends in the present example) of the developing container 120 (see FIG. 16). The cam member 143 is further rotated and pushes the inner wall 144 of the developing container 120 in a direction in which the developing container 120 separates from the photoconductor body assembly 101 (see FIG. 17).

Thus, the developing container 120 having been pushed by the cam member 143 is rotated about the pivot shaft 128, thereby the developing assembly 102 is separated from the photoconductor body assembly 101 by a dimension m.

In this state, the retraction mechanism 140 causes the front side of the developing assembly 102 in the longitudinal direction to be retracted from the photoconductor body assembly 101. However, the rear side of the developing assembly 102 in the longitudinal direction is not retracted from the photoconductor body assembly 101.

(2) Pulling Operation of Photoconductor Body Assembly

It is sufficient that, after the retracting operation with the retraction mechanism 140 has been performed, the user pull the photoconductor body assembly 101 of the process cartridge 100 as illustrated in FIGS. 18A to 20B. As the photoconductor body assembly 101 is pulled, the gap forming mechanism 160 operates so as to form a gap, the size of which is larger than that of a gap formed before the pulling of the photoconductor body assembly 101 is performed, between the photoconductor body 31 and the developing roller 121. Thus, the photoconductor body 31 is removed from the assembly receiving portion U without interference with the developing roller 121.

Figure 18A:
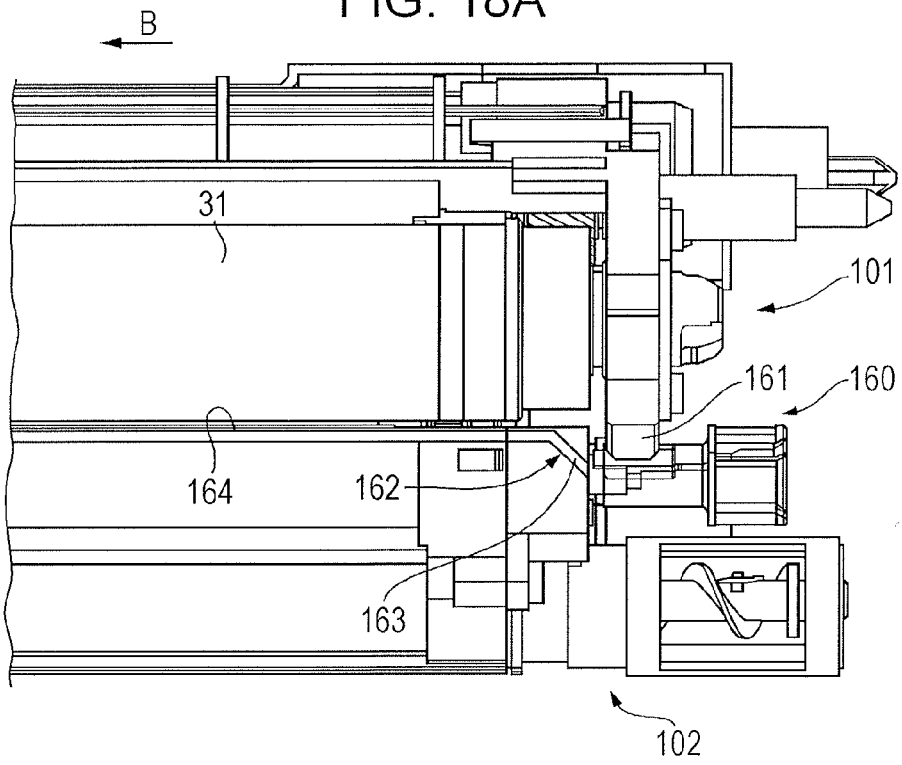
FIGS. 18A and 18B illustrate an operational process (1) of pulling the photoconductor body assembly performed with the retraction mechanism after the developing assembly retracting operation has been performed.
Figure 18B:
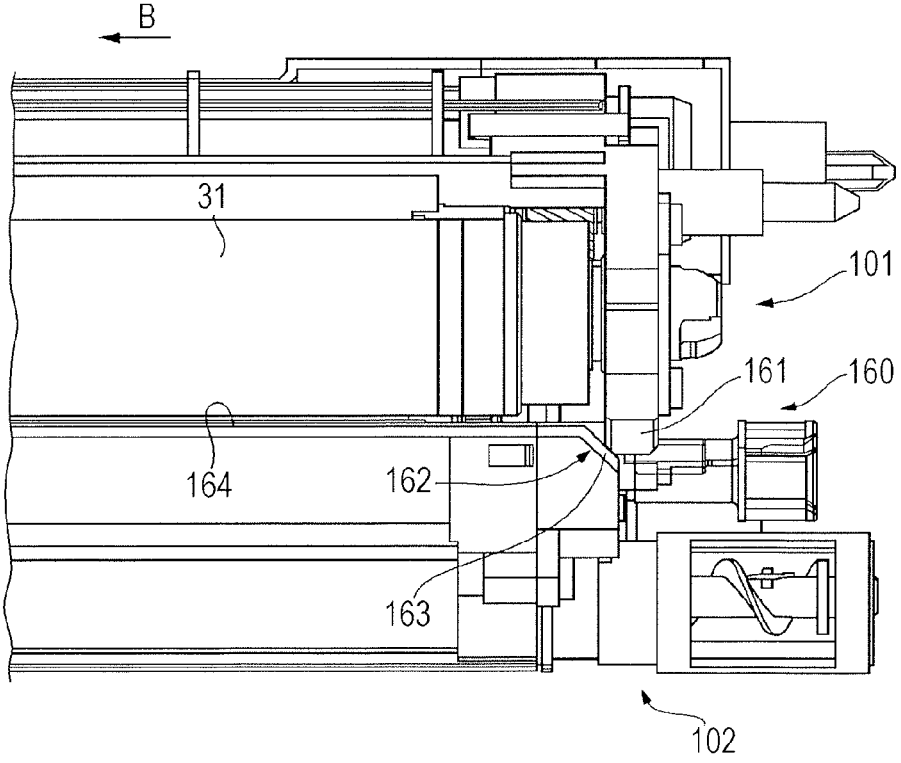

In such an operational process, by pulling the photoconductor body assembly 101 in an arrow B direction by several mm (for example, 3 to 5 mm), the projection 161 of the photoconductor body assembly 101 is brought into contact with the inclined guide portion 163 of the guide rail 162 of the developing assembly 102 as illustrated in FIGS. 18A and 18B.

Figure 19A:
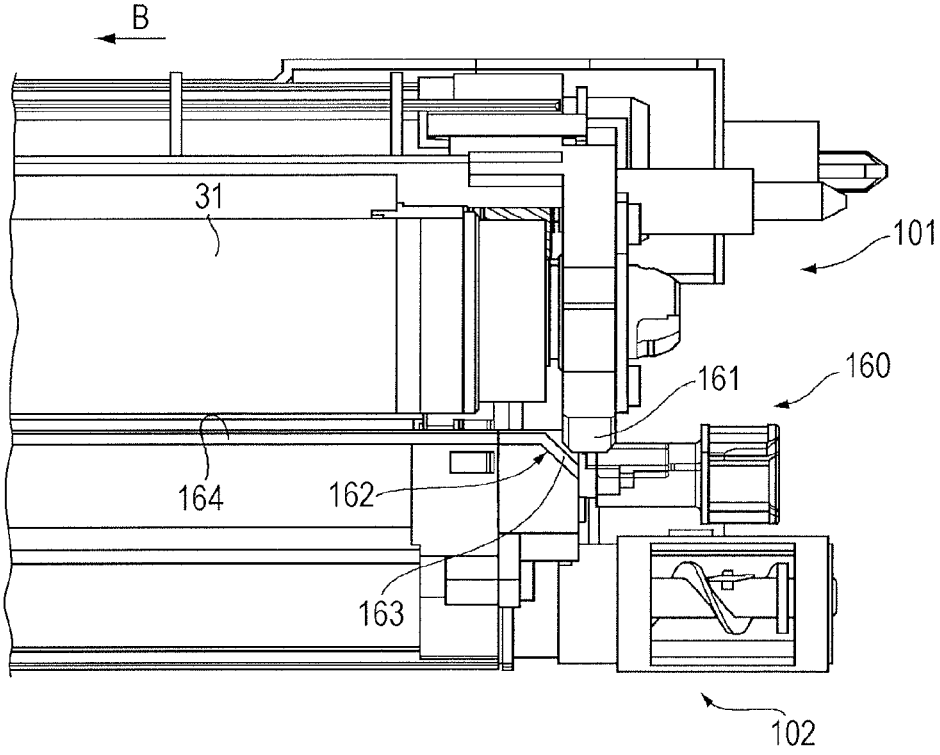
FIGS. 19A and 19B illustrate an operational process (2) of pulling the photoconductor body assembly performed with the retraction mechanism after the developing assembly retracting operation has been performed.
Figure 19B:
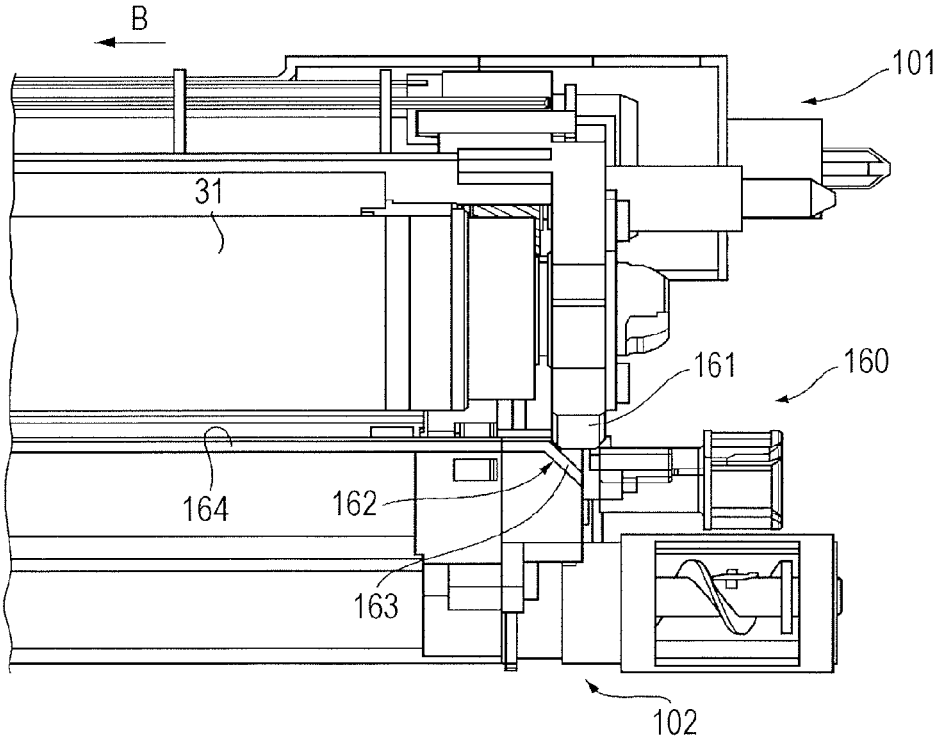
Figure 21:
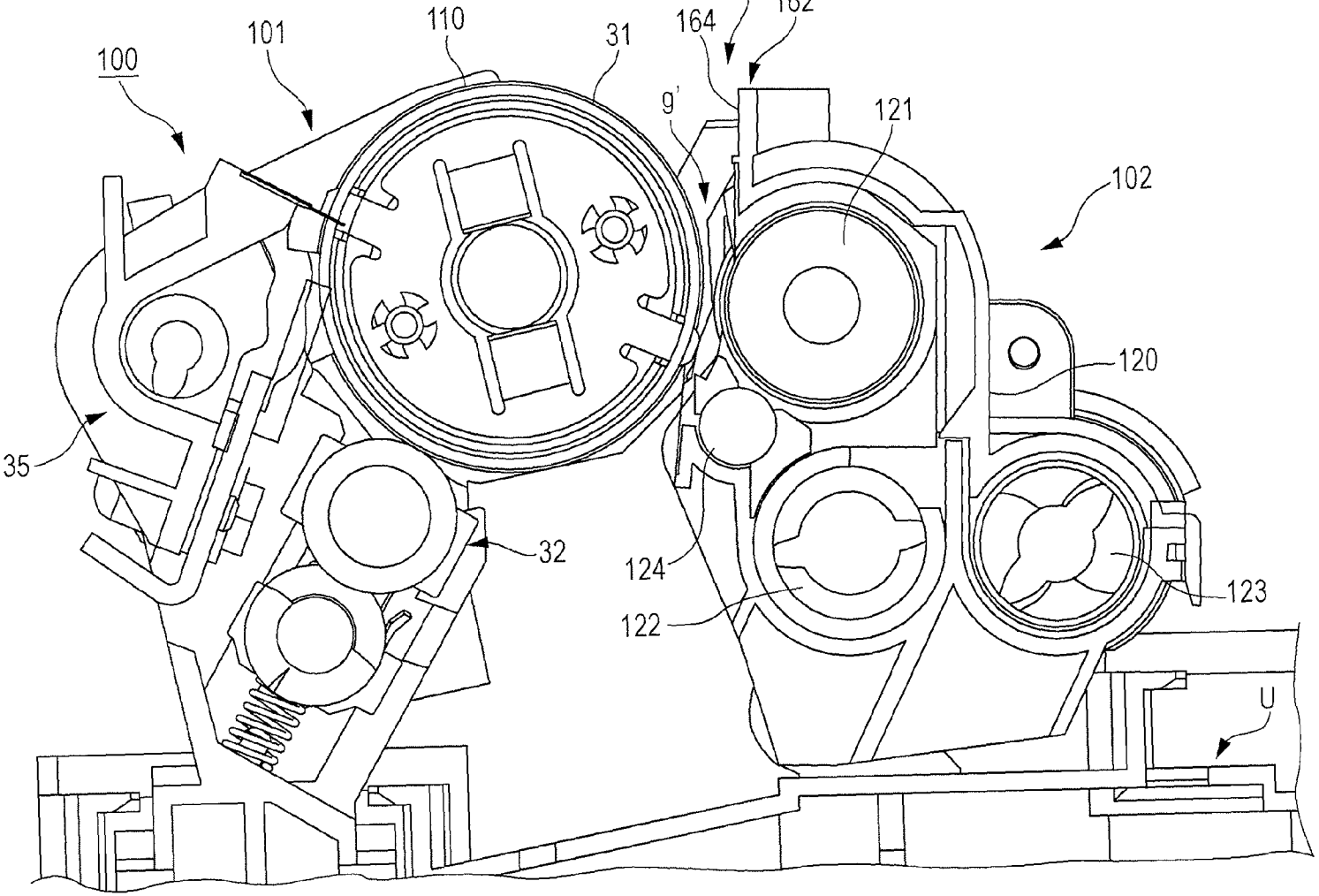
FIG. 21 illustrates a state of the operational processes (1) and (2) of pulling the photoconductor body assembly illustrated in FIGS. 18A, 18B, 19A and 19B seen from the front side.

In this state, by further pulling the photoconductor body assembly 101 in the arrow B direction, the projection 161 of the photoconductor body assembly 101 is moved along the inclined guide portion 163 of the guide rail 162 of the developing assembly 102 as illustrated in FIGS. 19A and 19B, thereby pushing the developing assembly 102 in a direction in which the developing assembly 102 separates from the photoconductor body assembly 101. Thus, as illustrated in FIG. 21, the gap forming mechanism 160 forms a gap g' between the photoconductor body 31 and the developing roller 121.

Figure 20A:
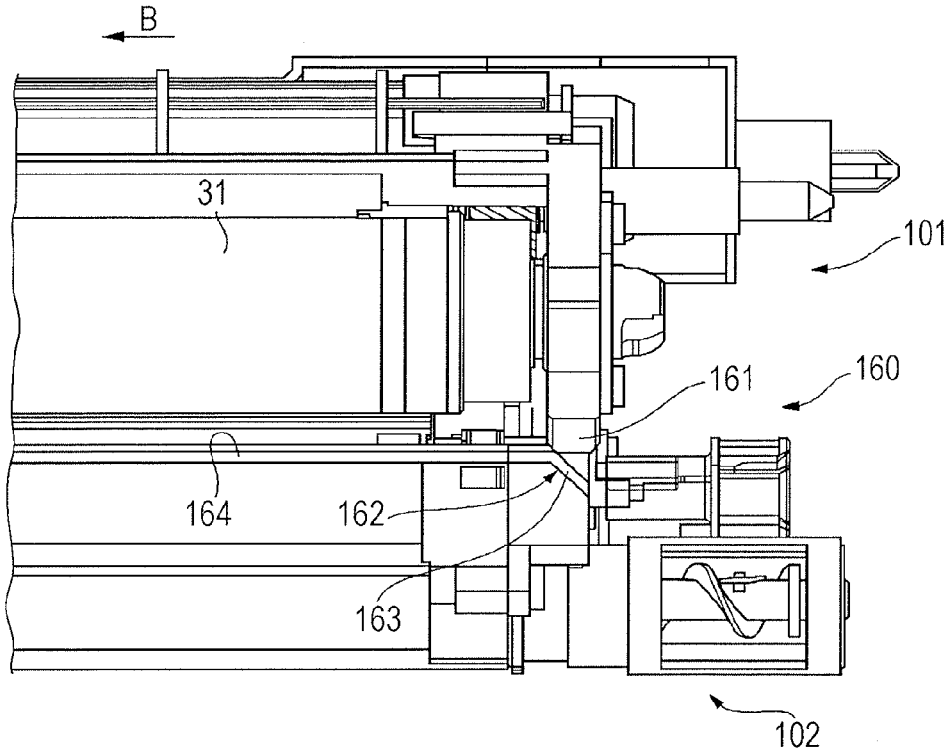
FIGS. 20A and 20B illustrate an operational process (3) of pulling the photoconductor body assembly performed with the retraction mechanism after the developing assembly retracting operation has been performed.
Figure 20B:
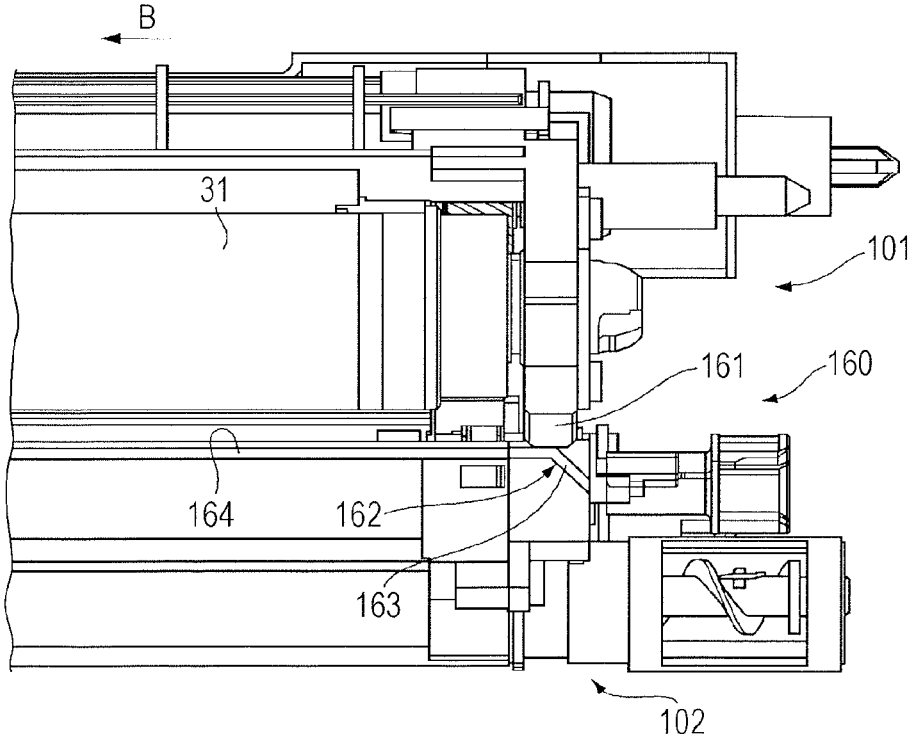
Figure 22:
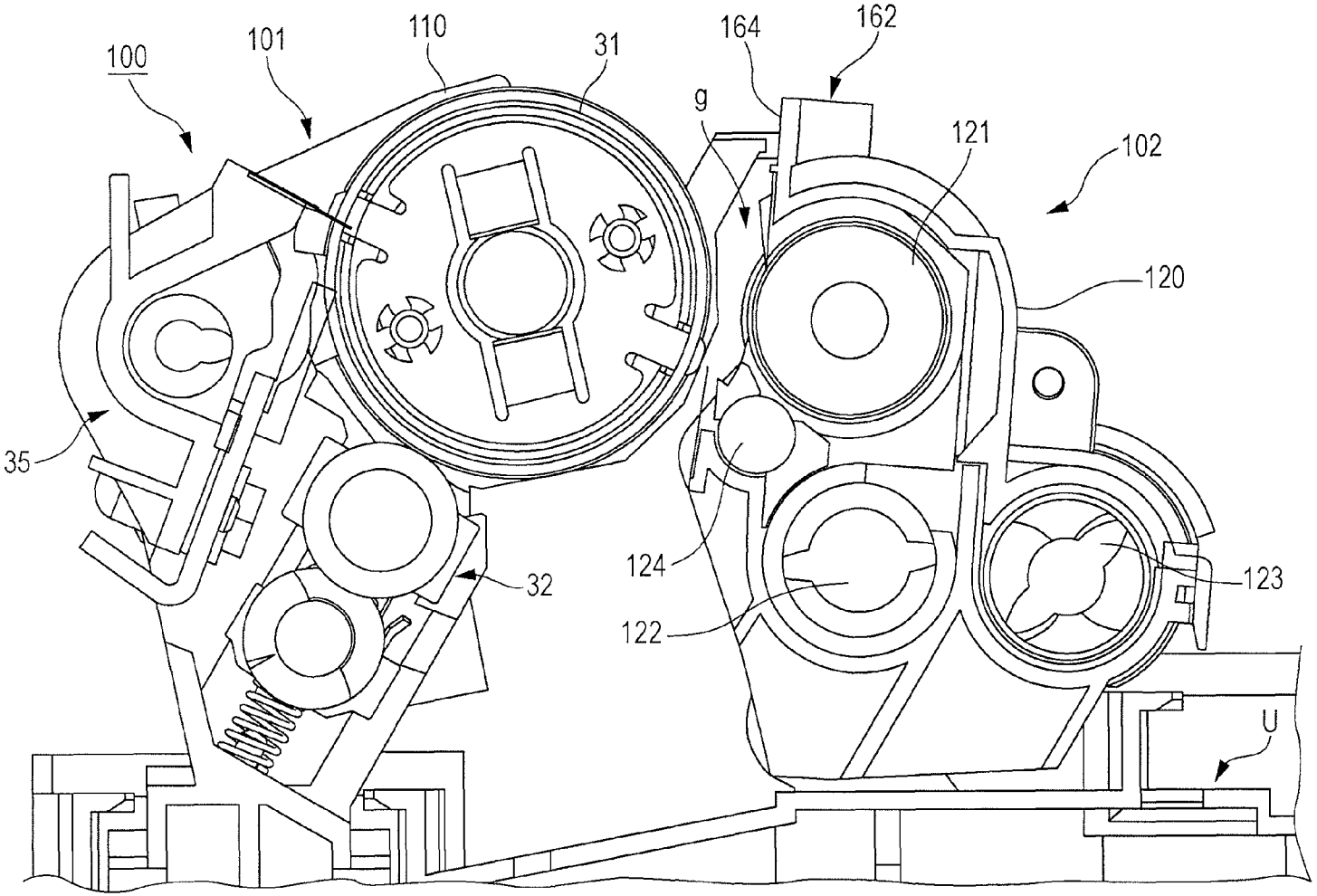
FIG. 22 illustrates a state of the operational process (3) of pulling the photoconductor body assembly illustrated in FIGS. 20A and 20B seen from the front side.

After that, by further pulling the photoconductor body assembly 101 in the arrow B direction, the projection 161 of the photoconductor body assembly 101 slides over the inclined guide portion 163 and is moved to the linear guide portion 164 of the guide rail 162 of the developing assembly 102 as illustrated in FIGS. 20A and 20B, thereby further pushing the developing assembly 102 in a direction in which the developing assembly 102 separates from the photoconductor body assembly 101. Thus, as illustrated in FIG. 22, the gap forming mechanism 160 forms the gap g (>g') between the photoconductor body 31 and the developing roller 121.

When the projection 161 of the photoconductor body assembly 101 reaches the linear guide portion 164 of the guide rail 162 of the developing assembly 102, the gap g is formed between the photoconductor body 31 and the developing roller 121. Thus, after that, even when the photoconductor body assembly 101 is pulled further, the photoconductor body 31 and the developing roller 121 do not interfere with each other, and the photoconductor body assembly 101 is removed from the assembly receiving portion U.

(3) Inserting Operation of Photoconductor Body Assembly

Next, in order to attach a new photoconductor body assembly 101 to the assembly receiving portion U of the apparatus housing 21, it is sufficient that the developing assembly 102 be retracted to a retracted position with the retraction mechanism 140, and in this state, the photoconductor body assembly 101 be inserted into a position, which is to receive the photoconductor body assembly 101, of the assembly receiving portion U of the apparatus housing 21.

At this time, it is sufficient that the projection 161 of the photoconductor body assembly 101 be brought into contact with the guide rail 162 of the developing assembly 102 along the guide rail 162 and, in this state, the photoconductor body assembly 101 be inserted to the specified set position.

In this state, by the operation of the gap forming mechanism 160, the gap g is formed between the photoconductor body 31 and the developing roller 121. Thus, the photoconductor body 31 is attached to the assembly receiving portion U without interference with the developing roller 121.

Second Exemplary Embodiment

Figure 23:
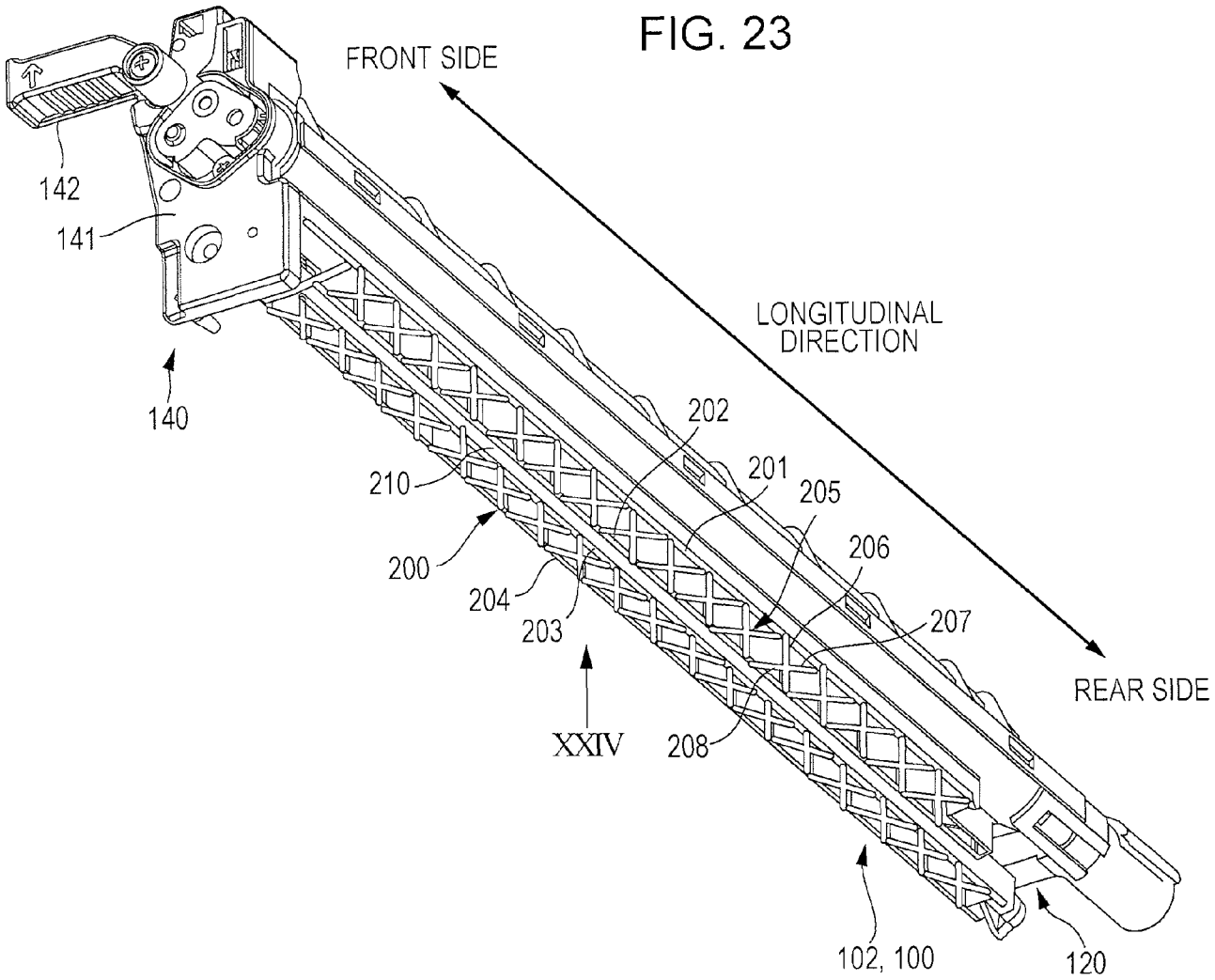
FIG. 23 illustrates an example of the developing assembly of the process cartridge of the image forming apparatus according to a second exemplary embodiment.

FIG. 23 illustrates part of the developing assembly used in the process cartridge of the image forming apparatus according to a second exemplary embodiment.

The basic configurations of the image forming apparatus and its process cartridge in the present exemplary embodiment are substantially the same as those of the first exemplary embodiment except for an external structure of the developing container 120 of the developing assembly 102, which is different from that of the first exemplary embodiment.

The same elements as those in the first exemplary embodiment are denoted by the same reference signs as those in the first exemplary embodiment, and the detailed description thereof is omitted here.

Figure 24:
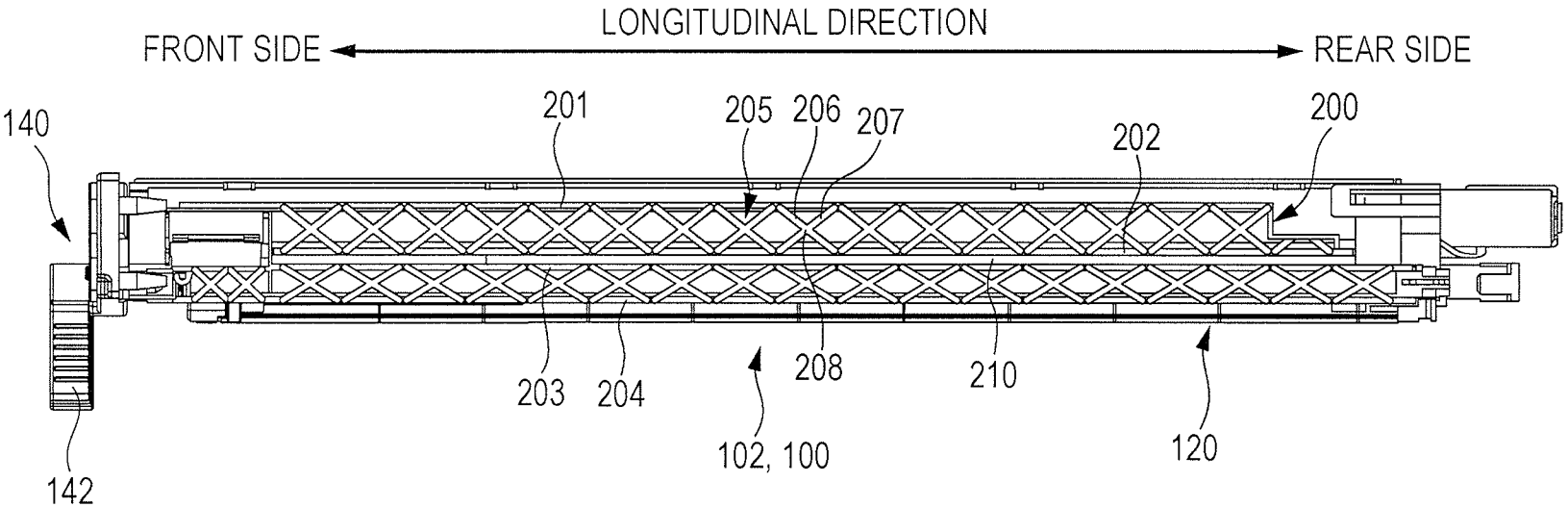
FIG. 24 illustrates the developing assembly illustrated in FIG. 23 seen in a XXIV direction.

In the present exemplary embodiment, as illustrated in FIGS. 23 and 24, a reinforcing structure, which increases torsional rigidity in the longitudinal direction of the developing assembly 102, is formed in a bottom portion of the developing container 120 of the developing assembly 102, the bottom portion to be attached to the assembly receiving portion U of the apparatus housing 21.

In the present example, the developing container 120 includes a single or plural components, which are each integrally formed of, for example, a resin material such as an acrylonitrile butadiene styrene (ABS) resin.

Particularly in the present exemplary embodiment, reinforcing ribs 200 serving as reinforcing frame elements are integrally formed with the developing container 120 on an outer side of a bottom wall of the bottom portion of the developing container 120. The reinforcing ribs 200 include plural (four in the present example) rail ribs 201 to 204 as first ribs, which correspond to first frame elements, and connection ribs 205 as second ribs, which correspond to second frame elements. The rail ribs 201 to 204 have a projecting shape in section and extend in the longitudinal direction of the developing container 120. The connection ribs 205 connect the first and second rail ribs 201 and 202 to each other, and the third and fourth rail ribs 203 and 204 to each other.

The connection ribs 205 of the present example include first inclined ribs 206 and second inclined ribs 207. The first inclined ribs 206 extend between the rail ribs 201 and 202 that oppose each other and between the rail ribs 203 and 204 that oppose each other in a specified inclined direction. The second inclined ribs 207 extend in an inclined direction so that the second inclined ribs 207 intersect the first inclined ribs 206 so as to form cross shapes. An intersection portion 208 is formed at the intersection of each of the first inclined ribs 206 and a corresponding one of the second inclined ribs 207, the intersection formed at middle portions of the first and the second inclined ribs 206 and 207.

Here, the rail ribs 201 to 204 are elements that suppress torsion of the developing container 120 in the longitudinal direction. The connection ribs 205 are elements that disperse stress distortion acting on the rail ribs 201 to 204. The sectional shape of the rail ribs 201 to 204 and the connection ribs 205 may be appropriately selected from shapes such as a substantially semi-circular shape, a triangle, a rectangle, and a polygon. However, from the viewpoint of ensuring sufficient torsion rigidity, the reinforcing ribs 200 may have a substantially semi-circular shape in section.

Power Supply Structure

Figure 25:
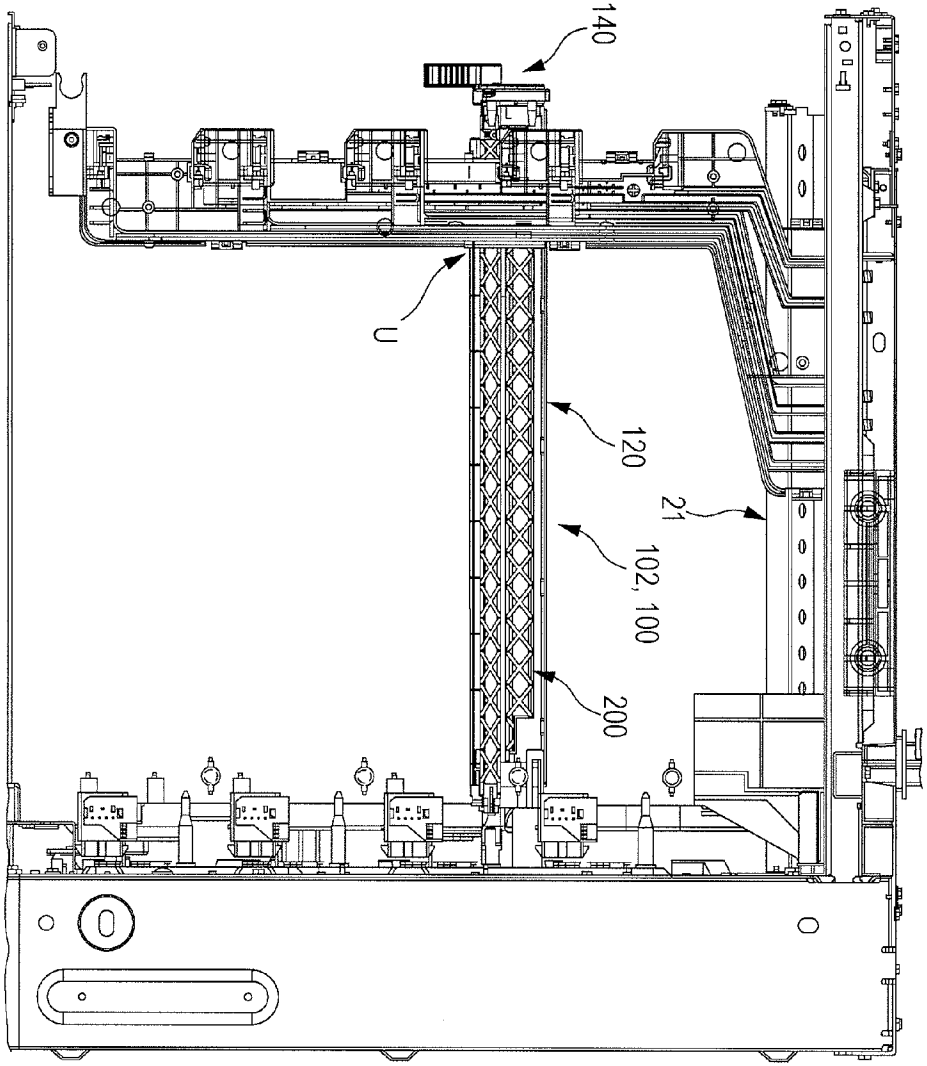
FIG. 25 illustrates an example of a power supply structure that supplies power to the developing assembly.
Figure 26:
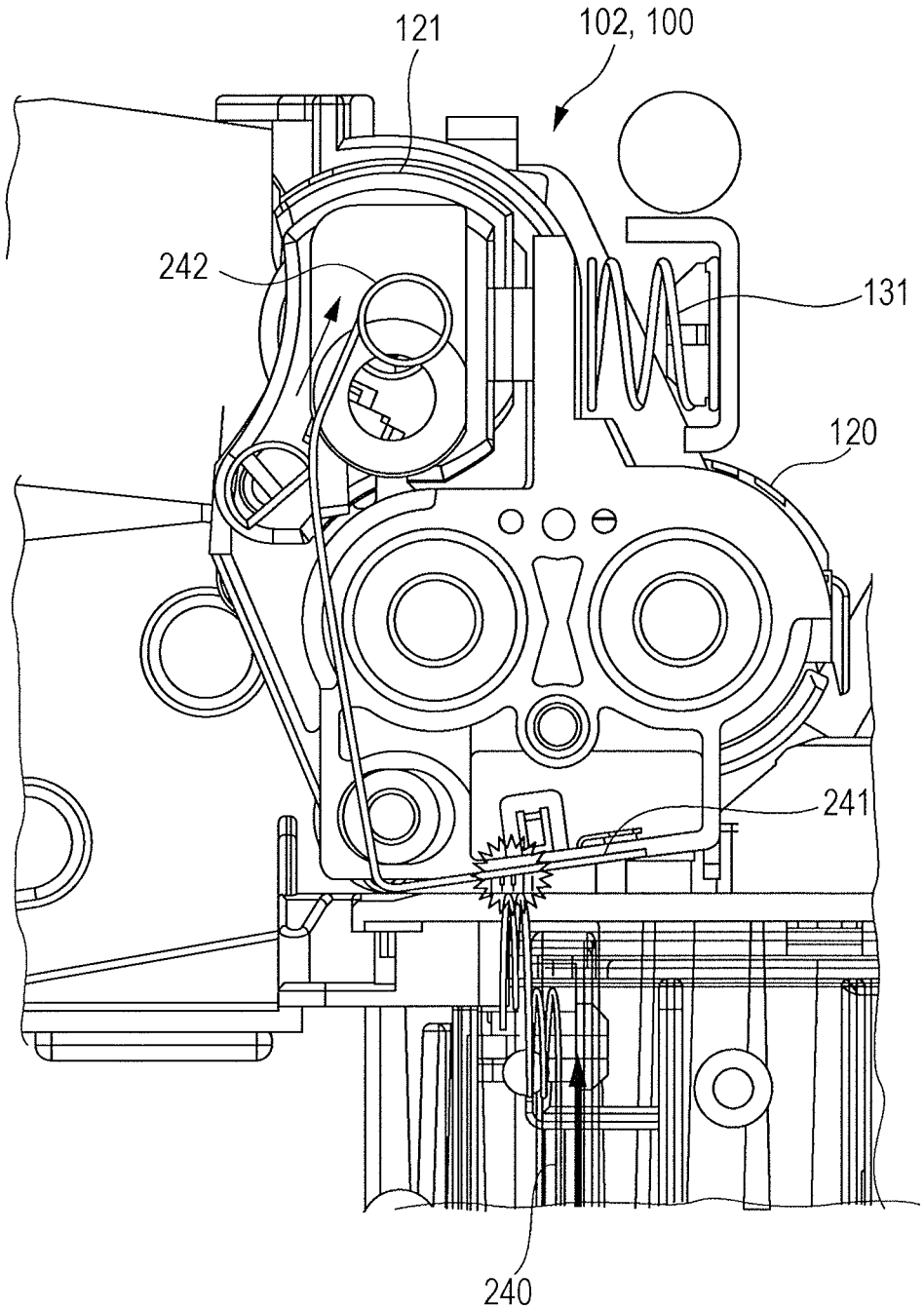
FIG. 26 illustrates a power supply path of the example of the power supply structure illustrated in FIG. 25.
Figure 27:
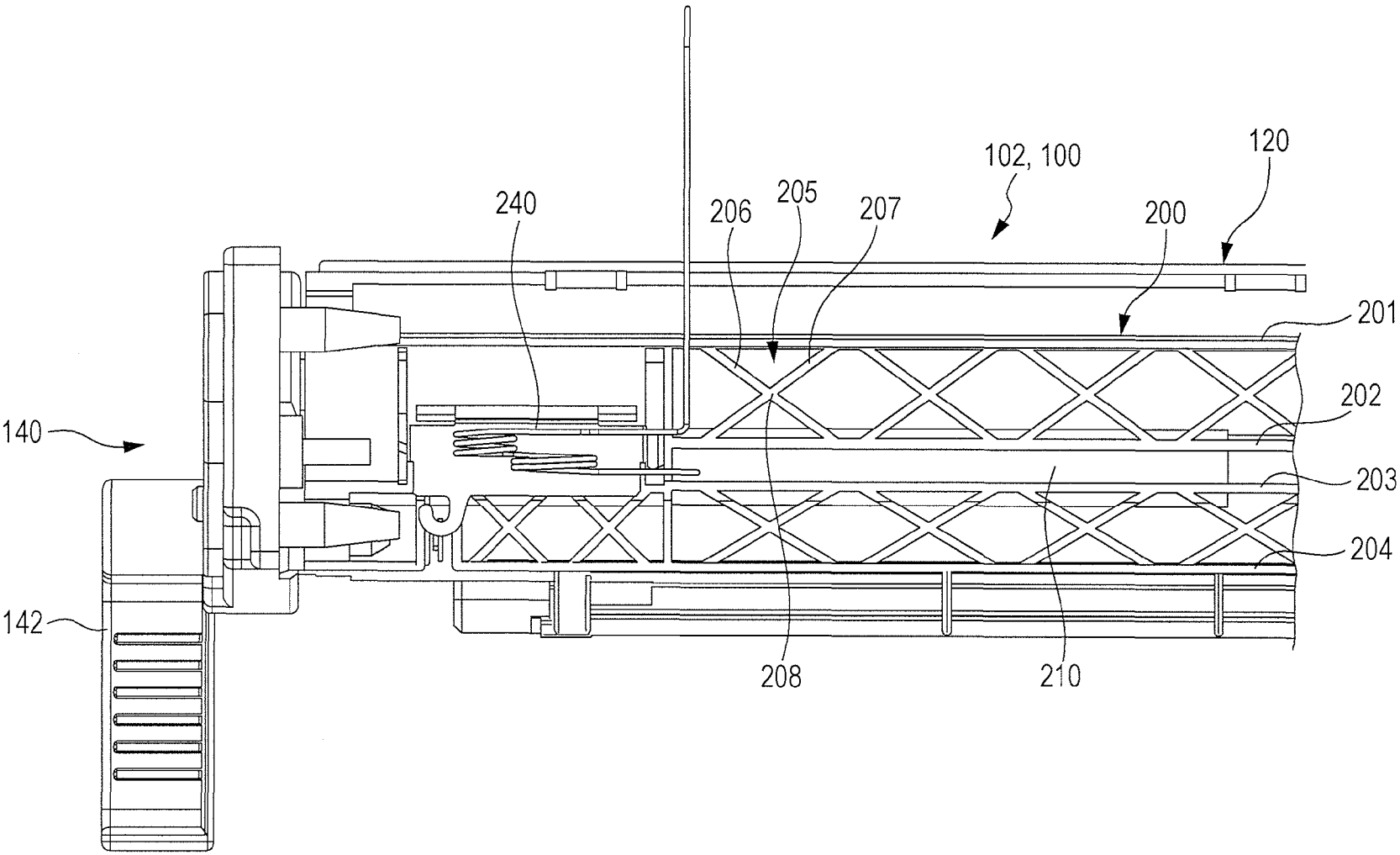
FIG. 27 illustrates the relationship between the developing assembly and a power supply portion on the assembly receiving portion side used in the second exemplary embodiment.

In the present example, it is required that the developing assembly 102 generate a developing electric field between the developing assembly 102 and the photoconductor body 31 by applying a developing voltage to the developing roller 121. Thus, as illustrated in FIGS. 25 to 27, it is required that a power supply structure be provided so as to supply power from the assembly receiving portion U of the apparatus housing 21 to the developing assembly 102.

In the present example, a torsion spring 240 for power supply is provided in the assembly receiving portion U of the apparatus housing 21, and a power supply portion 241 to be in contact with the torsion spring 240 is provided in the developing assembly 102. Also in the developing assembly 102, a power supply spring 242, through which the power is supplied from the power supply portion 241 to a shaft portion of the developing roller 121 is provided.

Figure 28A:
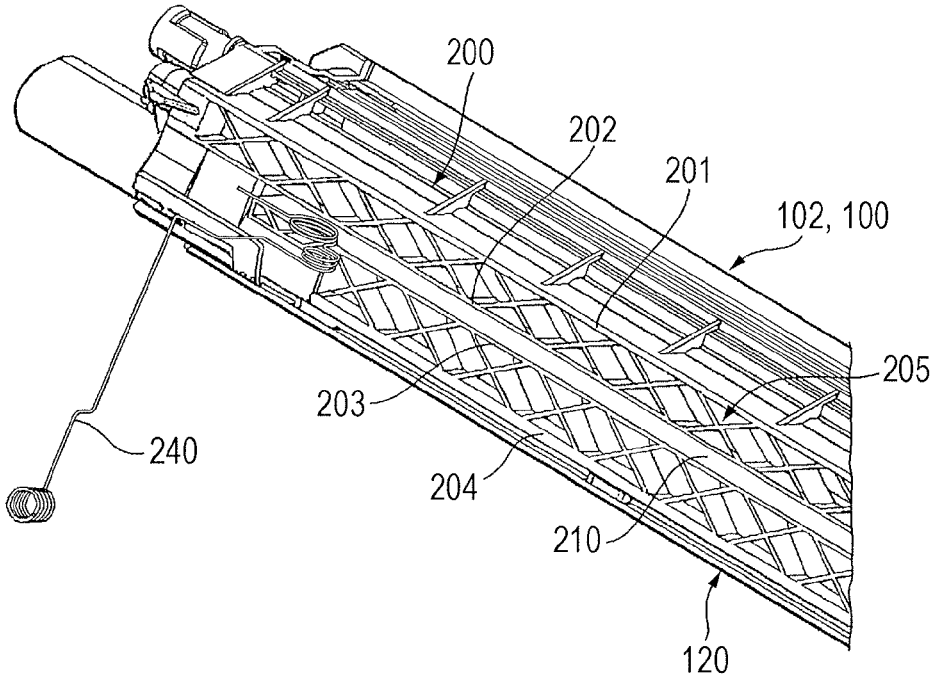
FIGS. 28A and 28B illustrate the relationship between the developing assembly and the power supply portion of the assembly receiving portion when the developing assembly is inserted into the assembly receiving portion.
Figure 28B:
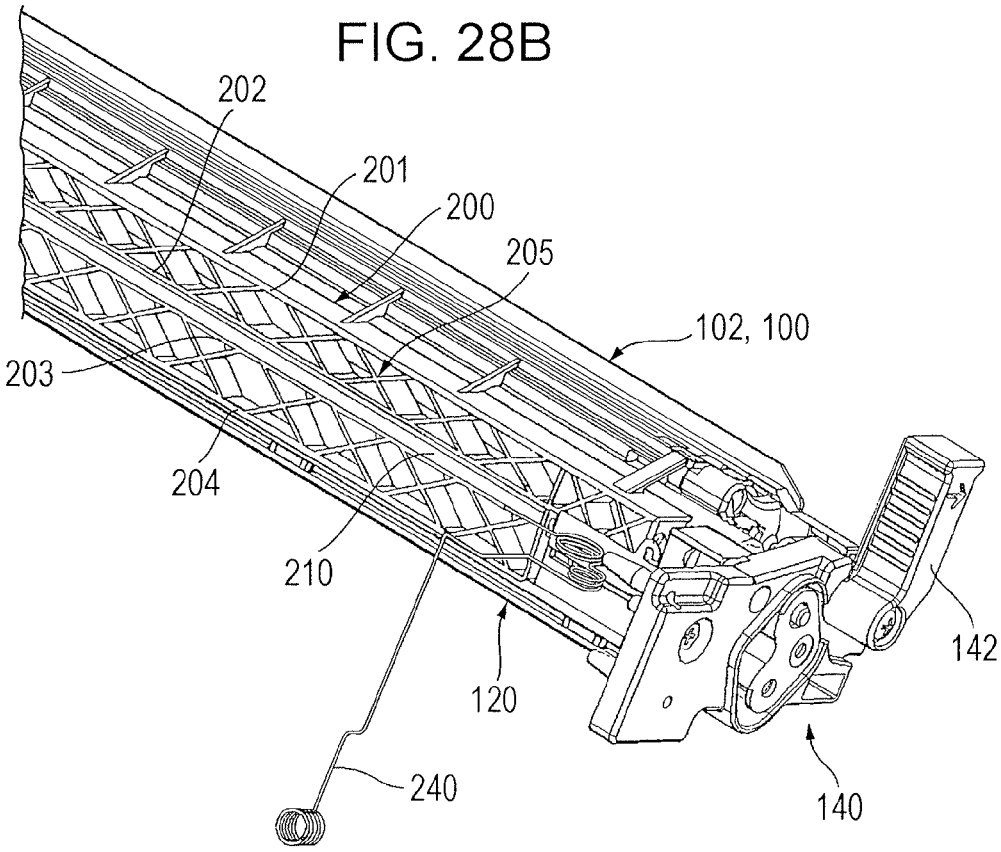

Particularly in the present example, the reinforcing ribs 200 are formed in the bottom portion of the developing container 120 of the developing assembly 102. However, since the torsion spring 240 for power supply is provided in the assembly receiving portion U of the apparatus housing 21, the connection ribs 205 are not provided between the second and third rail ribs 202 and 203 in the present example. Thus, when the developing assembly 102 is inserted into and attached to the assembly receiving portion U of the apparatus housing 21, the torsion spring 240 for power supply is moved in and along a groove 210 between the rail ribs 202 and 203 as illustrated in FIGS. 28A and 28B. Accordingly, it is unlikely that the torsion spring 240 for power supply of the assembly receiving portion U is removed as the developing assembly 102 is inserted.

Attachment and Detachment of Process Cartridge

Here, as is the case with the first exemplary embodiment, it is assumed that, for example, the photoconductor body assembly 101 of the process cartridge 100 is pulled from the process cartridge 100, which is attached to the assembly receiving portion U of the apparatus housing 21. Operational processes of the pulling of the photoconductor body assembly 101 are described as follows.

In this case, similarly to the first exemplary embodiment, the retracting operation is initially performed with the retraction mechanism (not illustrated, having a structure similar to that in the first exemplary embodiment), thereby retracting the developing assembly 102 relative to the photoconductor body assembly 101. In this state, by pulling the photoconductor body assembly 101 from the assembly receiving portion U of the apparatus housing 21, the gap forming mechanism 160 operates so as to allow the photoconductor body assembly 101 to be pulled similarly to the first exemplary embodiment.

In the present example, out of the front and rear sides of the developing assembly 102 in the longitudinal direction of the developing assembly 102, the front side is retracted from the photoconductor body assembly 101 by the retraction mechanism (not illustrated) while the rear side is not retracted by the retraction mechanism. Thus, the rear side of the developing assembly 102 in the longitudinal direction of the developing assembly 102 is subjected to torsion when the developing assembly 102 is retracted by the retraction mechanism.

In this case, since the stress distortion due to the torsion acts on the developing container 120 of the developing assembly 102, it may be difficult for the developing assembly 102 to have a sufficient life in the case where the developing container 120 does not have a sufficient torsion rigidity.

In the present exemplary embodiment, the developing container 120 of the developing assembly 102 has the reinforcing ribs 200 in its bottom portion. Thus, the torsion in the longitudinal direction of the developing container 120 is suppressed by the rail ribs 201 to 204, and the stress acting on the developing container 120 is dispersed by the connection ribs 205. In particular, the connection ribs 205 including the inclined ribs 206 and 207 that intersect one another at the intersection portions 208 so as to form cross shapes as in the present example further facilitate dispersion of the stress. This may further suppress the concentration of the stress.

Furthermore, in the present example, although the bottom portion of the developing container 120 of the developing assembly 102 has the reinforcing ribs 200, the connection ribs 205 of the reinforcing ribs 200 are not formed in part of the bottom portion of the developing container 120 corresponding to the power supply portion. Thus, there is no concern that the reinforcing rib 200 structure obstructs the attachment of the developing assembly 102.

Variants

Although the bottom portion of the developing container 120 of the developing assembly 102 has the reinforcing ribs 200 in a specified pattern in the present exemplary embodiment, the reinforcing ribs 200 are not limited to this. For example, the reinforcing ribs 200 may be formed as illustrated in FIG. 29 or 30.

Figure 29:
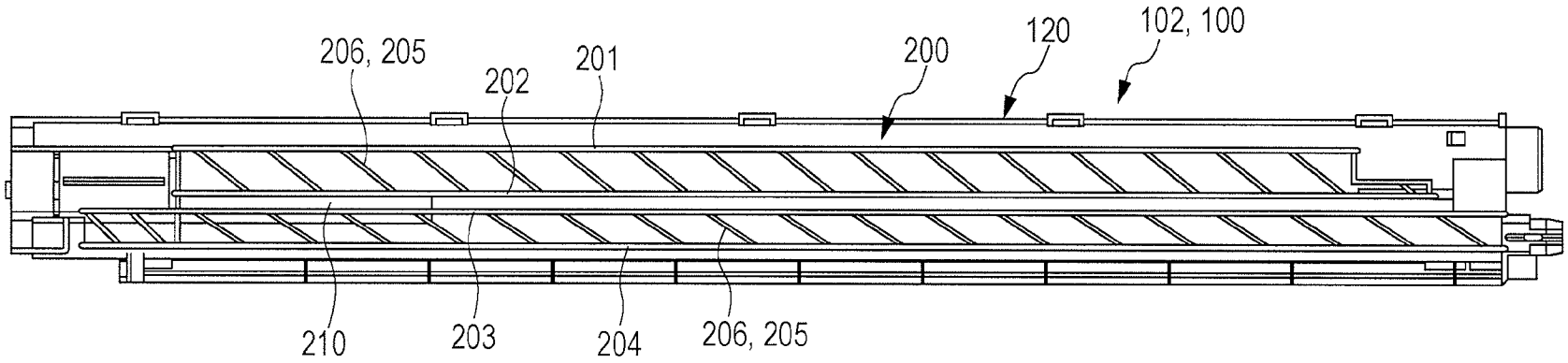
FIG. 29 illustrates a first variant of the developing assembly according to the second exemplary embodiment.
Figure 30:
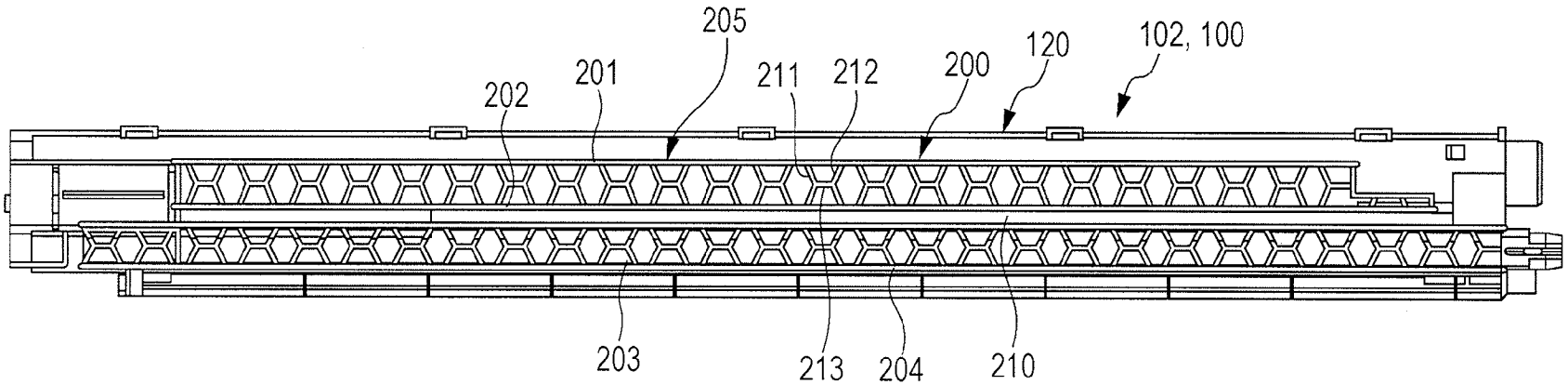
FIG. 30 illustrates a second variant of the developing assembly according to the second exemplary embodiment.

The reinforcing ribs 200 according to a first variant may include, for example as illustrated in FIG. 29, the plural (four in the present example) rail ribs 201 to 204 as the first ribs and the connection ribs 205 as the second ribs. In this case, the rail ribs 201 to 204 have a projecting shape in section and extend in the longitudinal direction of the developing container 120, and the connection ribs 205 connect the first and second rail ribs 201 and 202 to each other, and the third and fourth rail ribs 203 and 204 to each other. When a high torsion rigidity is not required, the connection ribs 205 may include only the inclined ribs 206 inclined in a predetermined direction.

The reinforcing ribs 200 according to a second variant may include the plural rail ribs 201 to 204 and inclined ribs 211 and 212 as the connection ribs 205 that connect the rail ribs 201 and 202 to each other and the rail ribs 203 and 204 to each other. In this case, the inclined ribs 211 and 212, which are inclined so as to cross one another, may be connected to one another through linear intersecting portions 213.

Although the bottom portion of the developing container 120 of the developing assembly 102 has the reinforcing ribs 200 in the present exemplary embodiment, the reinforcing ribs 200 are not limited to this. The reinforcing ribs 200 may be provided in another different surface in addition to or instead of the bottom portion of the developing container 120.

EXAMPLES

First Example

A first example uses the process cartridge according to the second exemplary embodiment, in which the bottom portion of the developing container 120 of the developing assembly 102 has the reinforcing ribs 200. These reinforcing ribs 200 includes four rail ribs 201 to 204 and the connection ribs 205 including the inclined ribs 206 and 207 that intersect one another at the intersection portions 208 to form cross shapes.

Second Example

In a second example, the reinforcing ribs 200 according to the second variant are provided instead of the reinforcing ribs 200 of the developing assembly 102 in the first example.

First Comparative Example

In a first comparative example, the reinforcing ribs 200 are removed from the developing container 120 of the developing assembly 102 of the first example.

Here, stress and the amount of deformation of the first example, the second example, and the first comparative example are measured under the following conditions: in each of the examples, the developing container is formed of an ABS resin; in each of the examples, the front side of the developing assembly in the longitudinal direction of the developing assembly is retracted with the retraction mechanism; and in each of the examples, the rear side of the developing assembly in the longitudinal direction of the developing assembly is urged at 15 N by the urging spring. The obtained results are listed in FIG. 31.

It is understood from the results in FIG. 31 that, compared to those obtained with the first comparative example, the maximum stress and the maximum amount of deformation are reduced with the first and second examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A process cartridge having a front side and a rear side, the process cartridge comprising:

an image holding body assembly that is inserted into and pulled from a predetermined assembly receiving portion in an insertion and pulling direction, which extends along a line that connects the front side and the rear side to each other, the image holding body assembly including an image holding body which holds a latent image and which has longitudinal ends;

a developing assembly that includes a developer holding body holding a developer, and a guide portion that extends in the insertion and pulling direction;

an urging member that urges the developing assembly so that the developer holding body of the developing assembly is pressed against both the longitudinal ends of the image holding body of the image holding body assembly;

a contacting and separating mechanism that is disposed on the front side in the insertion and pulling direction in the image holding body assembly and that is operated in a predetermined direction so as to cause the image holding body assembly and the developing assembly to be moved in a direction in which the image holding body assembly and the developing assembly are separated from each other against an urging force applied by the urging member; and a gap forming mechanism that forms a gap between the image holding body and the developer holding body on the rear side against the urging force of the urging member by bringing, when the image holding body assembly is pulled in the insertion and pulling direction while the developing assembly is separated from the image holding body assembly by the contacting and separating mechanism, part of the image holding body assembly on the rear side in the insertion and pulling direction into contact with the guide portion, the gap forming mechanism forming the gap having a size larger than a size of a gap existing before the image holding body assembly is pulled.

2. The process cartridge according to claim 1, wherein the size of the gap formed by the gap forming mechanism is smaller than a distance by which the image holding body and the developer holding body are separated from each other on the front side by the contacting and separating mechanism.

3. The process cartridge according to claim 2, wherein the gap forming mechanism includes the guide portion that is disposed on the rear side in the developing assembly and inclined so that a distance between the guide portion and the image holding body assembly gradually reduces toward the front side, and a projection disposed on the rear side on the image holding body assembly, the projection projecting toward the guide portion, and the projection being brought into contact with the guide portion when the image holding body assembly is pulled in the insertion and pulling direction.

4. The process cartridge according to claim 1, wherein the contacting and separating mechanism includes a rotatable operation member disposed on the front side in the developing assembly, and a cam member that is rotated as the operation member is rotated, wherein the contacting and separating mechanism causes the image holding body and the developer holding body to be in contact with and out of contact from each other in accordance with a position of the cam member.

5. An image forming apparatus comprising:

an apparatus housing that includes a predetermined assembly receiving portion; and the process cartridge according to claim 1, the process cartridge being detachably attached to the assembly receiving portion of the apparatus housing.

* * * * *